US009221253B2

(12) United States Patent
Suzuki et al.

(10) Patent No.: US 9,221,253 B2
(45) Date of Patent: Dec. 29, 2015

(54) LIQUID EJECTION APPARATUS

(71) Applicant: Seiko Epson Corporation, Tokyo (JP)

(72) Inventors: Toshiyuki Suzuki, Matsumoto (JP); Osamu Shinkawa, Chino (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 14/504,796

(22) Filed: Oct. 2, 2014

(65) Prior Publication Data

US 2015/0158293 A1 Jun. 11, 2015

(30) Foreign Application Priority Data

Dec. 6, 2013 (JP) ..... 2013-253224

(51) Int. Cl.
*B41J 2/045* (2006.01)

(52) U.S. Cl.
CPC ..... *B41J 2/04588* (2013.01); *B41J 2/04581* (2013.01); *B41J 2/04596* (2013.01)

(58) Field of Classification Search
CPC ..... B41J 2/04581; B41J 2/04588; B41J 2/04503; B41J 2/04541; B41J 2/04593; B41J 2/04598
USPC ..... 347/19, 20, 54, 57, 60
See application file for complete search history.

(56) References Cited

U.S. PATENT DOCUMENTS 4,880,465 A 11/1989 Loria et al.
2014/0267480 A1* 9/2014 Yoshida ..... 347/10
2015/0070428 A1* 3/2015 Sudo et al. ..... 347/14

FOREIGN PATENT DOCUMENTS

JP 2004-299341 A 10/2004

* cited by examiner

*Primary Examiner* — Thinh Nguyen
(74) *Attorney, Agent, or Firm* — Harness, Dickey & Pierce, P.L.C.

(57) ABSTRACT

An ink jet printer includes an ejection unit including a nozzle which ejects a liquid containing a pigment; a cavity which communicates with the nozzle; and a piezoelectric element which is provided in the cavity, and a driving signal generation unit which generates a driving signal allowing the piezoelectric element to be displaced such that the cavity expands or is contracted. The ink jet printer includes a detection unit that detects a cycle of a residual vibration waveform of the piezoelectric element which is generated by the driving signal being applied to the piezoelectric element and indicates a value according to change of the pressure inside of the cavity and a determination unit that determines the pigment is settled based on the cycle of the residual vibration waveform detected by the detection unit.

6 Claims, 17 Drawing Sheets

TESTED VALUE AND CALCULATED VALUE OF RESIDUAL VIBRATION
(NORMAL TIME)

| SI (b1, b2, b3) | Tc1 | | | Tc2 | | |
|---|---|---|---|---|---|---|
| | Sa | Sb | Sc | Sa | Sb | Sc |
| (1, 1, 0) | H | L | L | H | L | L |
| (1, 0, 0) | H | L | L | L | H | L |
| (0, 1, 0) | L | H | L | H | L | L |
| (0, 0, 0) | L | H | L | L | H | L |
| (0 OR 1, 0 OR 1, 1) | L | L | H | L | L | H |

FIG. 19

| VALIDITY Flag | DETECTION SIGNAL NTc (CONTENTS TO BE COMPARED) | DETERMINATION RESULT SIGNAL Rs |
|---|---|---|
| 1 | Tx1 ≤ T ≤ Tx2 | 1: NORMAL |
| | T < Tx1 AND Ath < A | 2: EJECTION ABNORMALITY 《FIRST SEDIMENTATION STATE》 |
| | T < Tx1 AND A ≤ Ath | 3: EJECTION ABNORMALITY 《SECOND SEDIMENTATION STATE》 |
| | Tx2 < T ≤ Tx3 | 4: EJECTION ABNORMALITY 《PAPER DUST》 |
| | Tx3 < T | 5: EJECTION ABNORMALITY 《THICKENING》 |
| 0 | ——— | 6: EJECTION ABNORMALITY 《IN CASE WHERE INK HAS NOT BEEN INJECTED OR THE LIKE》 |

FIG. 20

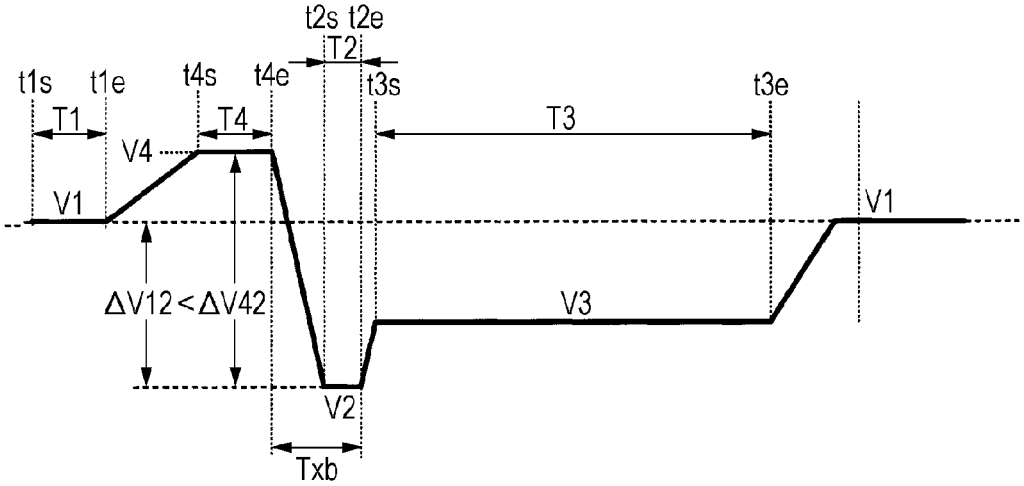

LIQUID EJECTION APPARATUS

BACKGROUND

1. Technical Field

The present invention relates to inspection on an ejection state of a liquid ejection apparatus.

2. Related Art

An ink jet type printer (hereinafter, referred to as an "ink jet printer") performs printing by ejecting an ink in a cavity. The ink is thickened when dried. When the ink in the cavity is thickened, this might cause ejection failure. In addition, when bubbles are included in the ink in the cavity or paper dust is adhered to a nozzle which ejects the ink, this might cause ejection failure as well. Accordingly, it is preferable that the ejection state of the ink be inspected.

JP-A-2004-299341 (FIG. 26) discloses a method of vibrating an ink in the cavity using a piezoelectric element and determining the ejection state by sensing behavior of the ink with respect to the residual vibration.

However, in the ink used for the liquid ejection apparatus, an ink of a pigment component contained in the ink with a high sedimentation velocity is present in terms of a color matter or a solvent. In the present specification, the term "sedimentation" means that components (for example, a pigment component) contained in a liquid (for example, an ink) are settled and the components contained in the liquid are accumulated on a lower layer of the liquid in a case where the liquid is left alone for a certain period of time. As sedimentation components of the white ink, a white pigment can be exemplified and a component linked thereto or adsorbed by the white pigment is contained.

Particularly, in the white ink, sedimentation of the pigment component tends to occur in terms of the composition thereof. In a case where such an ink is ejected, unevenness in the component occurs due to the sedimentation and an image is unstably formed during the time between the ink is filled in the cavity and then ejected therefrom.

However, in the technology in the related art, it is possible to determine whether the ink is thickened but not possible to determine whether the pigment component of the ink is sedimented.

SUMMARY

An advantage of some aspects of the invention is to provide a liquid ejection apparatus capable of determining whether or not sedimentation of a pigment component of an ink occurs, the liquid ejection apparatus including: an ejection unit that includes a nozzle ejecting a liquid which contains a pigment, a pressure chamber communicating with the nozzle, and a piezoelectric element provided in the pressure chamber; a driving signal generation unit that generates a driving signal which allows the piezoelectric element to be displaced such that the pressure chamber expands or is contracted; a residual vibration detection unit that detects a cycle of a residual vibration waveform of the piezoelectric element which is generated by the driving signal being applied to the piezoelectric element and which indicates a value according to change of pressure in the pressure chamber; and a determination unit that determines the pigment of the liquid is settled based on the cycle of the residual vibration waveform detected by the residual vibration detection unit.

According to the aspect of the invention, it is possible to determine whether the sedimentation of the pigment occurs in the pressure chamber using an easy process based on the cycle of the residual vibration waveform of the piezoelectric element which allows the pressure chamber to expand or be contracted. Accordingly, it is possible to selectively perform a flushing process (process of discarding a liquid (for example, an ink) in the pressure chamber) only in a case where the flushing process is actually required for recovering a normal ejecting function of the ejection unit and possible to manage with a stirring process or the like in a case of slight sedimentation or the like for which a process of stirring the pressure chamber is sufficient. Therefore, unnecessary consumption of the ink is suppressed because the number of execution of the flushing process can be suppressed to be minimized.

In addition, even in the ink jet printer in the related art, there is a recovery unit which performs a recovery process when ejection abnormality occurs. However, in the ink jet printer, since it is not possible to determine whether the pigment component of the ink is settled, the flushing process is performed even in a case where the flushing process is actually required (for example, in a case where the ink is thickened or severe sedimentation occurs).

According to the aspect of the above-described liquid ejection apparatus, it is preferable that the determination unit determine that the state of the liquid is normal in a case where the cycle of the residual vibration waveform is in a predetermined range, the liquid is thickened in a case where the cycle of the residual vibration waveform is longer than the predetermined range, and the pigment is settled in a case where the cycle of the residual vibration waveform is shorter than the predetermined range.

According to the aspect of the invention, it is possible to determine whether the pigment is settled or the liquid is thickened in the pressure chamber using an easy process of comparing the cycle of the residual vibration waveform to the predetermined threshold.

Specifically, in a case of considering a circuit which indicates a calculation model of simple vibration on the assumption of residual vibration, the calculation model of the residual vibration can be represented by a sound pressure p, inertance m, compliance Cm, and acoustic resistance r. Here, when sedimentation of the pigment occurs, the weight of the ink in an ink channel is decreased and thus the inertance m is reduced because the weight of the ink is decreased by the weight of the pigment component which is aggregated and solidified after the sedimentation. In this manner, a characteristic residual vibration waveform whose frequency becomes higher (the cycle becomes shorter) compared to that at the time of normal ejection can be obtained. That is, the residual vibration waveform at the time when sedimentation occurs becomes a waveform having a short cycle T compared to that at the time of normal ejection. On the other hand, in a case where the ink is thickened, the acoustic resistance r is increased. In this case, a characteristic residual vibration waveform whose frequency becomes extremely lower (the cycle becomes longer) compared to that at the time of normal ejection and residual vibration is over-damped can be obtained. Therefore, it is possible to determine that the pigment is settled or the ink is thickened in the pressure chamber based on the cycle of the residual vibration waveform.

According to the aspect of the above-described liquid ejection apparatus, it is preferable that the residual vibration detection unit detect the cycle and amplitude of the residual vibration waveform, and the determination unit determine that a degree of sedimentation of the pigment is in a first sedimentation state in a case where the cycle of the residual vibration waveform is shorter than the predetermined cycle and the amplitude of the residual vibration waveform is greater than the predetermined value, and the degree of sedimentation of the pigment is in a second sedimentation state whose degree of sedimentation progresses further than that of the first sedimentation state in a case where the cycle of the residual vibration waveform is shorter than the predetermined cycle and the amplitude of the residual vibration waveform is smaller than or equal to the predetermined value.

According to the aspect of the invention, it is possible to determine the degree of sedimentation occurring in the pressure chamber using an easy process of respectively comparing the amplitude and the cycle of the residual vibration waveform to predetermined threshold values.

Specifically, at the time of the second sedimentation state, the inertance m becomes lower similarly to the first sedimentation state and the frequency of the residual vibration waveform becomes higher (the cycle T becomes shorter) when compared to that at the time of normal ejection, but the diameter of the nozzle becomes smaller due to the pigment component which is settled and then aggregated and solidified and the acoustic resistance r is increased as a phenomenon unique to the second sedimentation state.

Due to the decrease in the acoustic resistance r, a damping factor of the amplitude of the residual vibration waveform becomes lower and the residual vibration slowly decreases the amplitude thereof. In addition, the volume of the pressure chamber becomes substantially reduced due to the pigment component which is settled and then aggregated and solidified. Accordingly, the amplitude of the residual vibration waveform becomes smaller. That is, since the size of the amplitude of the residual vibration waveform at the time of the first sedimentation state is different from that at the time of the second sedimentation state, those can be identified based on the values of the amplitudes.

According to the aspect of the above-described liquid ejection apparatus, it is preferable that a control unit that controls the driving signal generation unit be included based on a determination result of the determination unit, and the control unit controls the driving signal generation unit so as to generate a stirring driving signal which allows the pressure chamber to expand or be contracted such that the liquid of the pressure chamber is stirred without allowing the liquid to be ejected from the nozzle in a case where the determination unit determines that the degree of sedimentation of the pigment is in the first sedimentation state and control the driving signal generation unit so as to generate a flushing driving signal which allows the whole liquid filled in the pressure chamber to be ejected from the nozzle in a case where the determination unit determines that the degree of sedimentation of the pigment is in the second sedimentation state.

According to the aspect of the invention, it is possible to selectively perform the flushing process only in a case where the flushing process is actually required for recovering a normal ejecting function of the ejection unit and possible to manage with a stirring process or the like in a case of slight sedimentation or the like for which a process of stirring the pressure chamber is sufficient. Therefore, unnecessary consumption of the ink is suppressed because the number of execution of the flushing process can be minimized.

According to the aspect of the above-described liquid ejection apparatus, it is preferable that the liquid containing the pigment be a white ink jet ink for textile printing which contains a white pigment and a urethane resin, and an average particle size of the white pigment be greater than or equal to 2 and the average particle size of the urethane resin be smaller than or equal to 12.

According to the aspect of the invention, since the liquid is a white ink jet ink with high redispersibility, execution of the stirring process is sufficient even when sedimentation occurs to a degree that the flushing process is necessary to be performed as the recovery process in a case where an ink in the related art is used. That is, unnecessary consumption of the ink can be suppressed because the number of execution of the flushing process can be further suppressed.

According to the aspect of the above-described liquid ejection apparatus, it is preferable that the liquid containing the pigment be a white ink for ink jet recording, have an average particle size of 200 nm to 400 nm, contain a white pigment made of a metal oxide, and satisfy a relationship of $0.5\times A \leq V \leq 1.3\times A$, and it is preferable that A represent the content (% by mass) of the white pigment contained in the white ink for ink jet printing and V represent a volume ratio (%) of the white pigment based on the total volume of the white ink for ink jet recording when the white pigment is completely settled in the white ink for ink jet recording.

According to the aspect of the invention, since the liquid has excellent ejection stability and is a white ink for ink jet recording capable of recording an image with high whiteness, a sediment is unlikely to be cured or thickened even when a sediment containing the white pigment is generated, and ejection failure is difficult to occur even if the white ink is stored for a long period of time in a state in which the white ink is supplied to the ink jet recording device. Therefore, execution of a stirring vibration process is sufficient even when sedimentation occurs to a degree that the flushing process is necessary to be performed as the recovery process in a case where an ink in the related art is used. That is, unnecessary consumption of the ink can be further suppressed because the number of execution of the flushing process can be suppressed.

According to the aspect of a method of controlling the liquid ejection apparatus of the invention, it is preferable that the liquid containing the pigment be an ink which includes a self-dispersion type pigment, a quaternary amino acid, and alkanediol, the alkanediol contain at least 1,6-hexanediol, and the quaternary amino acid be contained in an amount larger than that of the 1,6-hexanediol.

According to the aspect of the invention, since the liquid can suppress sedimentation due to aggregation of the pigment components and is an ink having excellent dispersion stability of the self-dispersion type pigment, unnecessary consumption of the ink can be suppressed because the number of execution of the flushing process can be further suppressed.

BRIEF DESCRIPTION OF THE DRAWINGS

The invention will be described with reference to the accompanying drawings, wherein like numbers reference like elements.

FIG. 19 is a view illustrating contents of a determination process performed by a determination unit.

FIG. 20 is a waveform diagram illustrating a waveform of a driving signal for inspection according to a second modified example.

DESCRIPTION OF EXEMPLARY EMBODIMENTS

Hereinafter, embodiments of the invention will be described with reference to the accompanying drawings. However, the scale and the size of respective units are different from the actual scale and size thereof. In addition, embodiments described below are preferred specific examples of the invention so that various technically preferable limitations are given, but the scale of the invention is not limited to embodiments unless description of limiting the invention is made in the description below.

A. Embodiment

In the present embodiment, an ink jet printer that ejects an ink (an example of a "liquid") and forms an image in a recorded medium (for example, paper for recording) will be described as an example of a liquid ejection apparatus.

Figure 1:
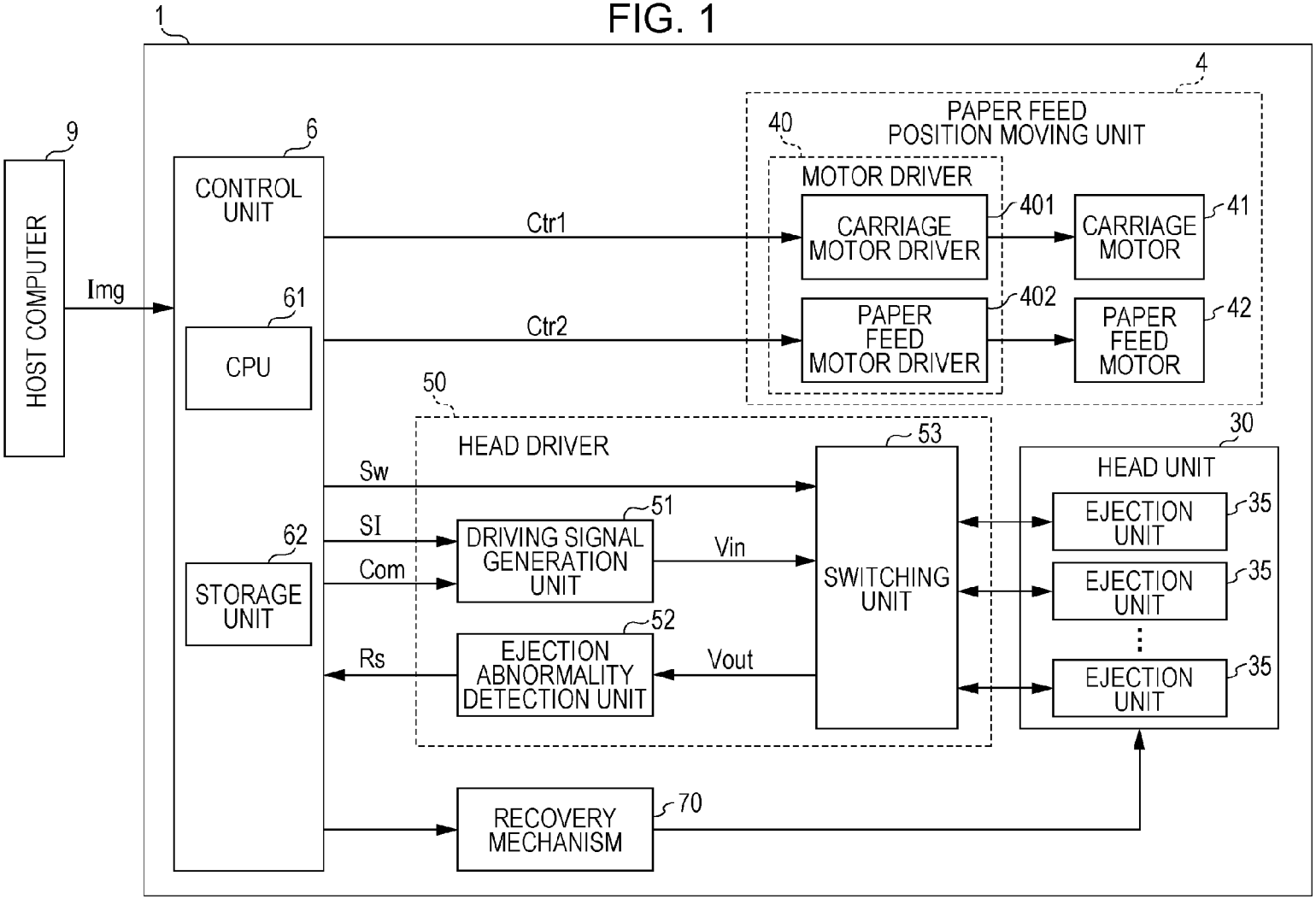
FIG. 1 is a block diagram illustrating a configuration of an ink jet printer according to an embodiment of the invention.

FIG. 1 is a functional block diagram illustrating a configuration of an ink jet printer 1 according to the present embodiment. As illustrated in the figure, the ink jet printer 1 includes a head unit 30 including M ejection units 35 (M is a natural number of 2 or more) which can eject an ink filled therein, a head driver 50 driving the head unit 30, a paper feed position moving unit 4 for moving a relative position of the head unit 30 with respect to a recorded medium, and a recovery unit 70 that performs a recovery process for recovering a normal ejecting function of the ejection unit 35 in a case where "a state of an ink which may cause an ejection abnormality (hereinafter, simply referred to as "ejection abnormality")" is detected in the ejection unit 35.

Here, "ejection abnormality" is detected by the state of the ink in a cavity of the ejection unit 35 and can be detected at the time when abnormality of ejection due to the ejection unit 35 has not occurred yet.

Further, the ink jet printer 1 includes a control unit 6 that controls execution of various processes such as a printing process of forming an image on the recorded medium, an ejection abnormality detecting process of detecting ejection abnormality of the ejection unit 35 and determining the cause thereof, and a recovery process of recovering a normal ejecting function of the ejection unit when ejection abnormality is detected, by controlling operations of the paper feed position moving unit 4, the head driver 50, and the recovery unit 70 based on image data Img supplied from a host computer 9 of a personal computer, a digital camera, or the like.

The control unit 6 includes a CPU 61 and a storage unit 62. The storage unit 62 includes an Electrically Erasable Programmable Read-Only Memory (EEPROM) which is a kind of a non-volatile semiconductor memory storing the image data Img supplied from the host computer 9 through an interface unit (not illustrated) in a data storage area. Further, the storage unit 62 includes a Random Access Memory (RAM) that temporarily develops a control program for temporarily storing data required when a printing process of information related to the shape of the recorded medium or the like is performed and ejection abnormality detection result data indicating a result obtained by the ejection abnormality detecting process and for performing various processes such as a printing process. In addition, the storage unit 62 includes a PROM which is a kind of a non-volatile semiconductor memory that stores a control program controlling respective units of the ink jet printer 1.

The CPU 61 controls execution of various processes such as the printing process, the ejection abnormality detecting process, and the recovery process. More specifically, the CPU 61 stores the image data Img supplied from the host computer 9 in the storage unit 62. Further, the CPU 61 generates various signals such as driver control signals Ctr1 and Ctr2 for controlling driving the paper feed position moving unit 4, a print signal SI, a switching control signal Sw, and a driving waveform signal Com for controlling driving the head driver 50 and various control signals for controlling driving the recovery unit 70 based on various pieces of data stored in the storage unit 62 such as the image data Img, and supplies these signals to respective units of the ink jet printer 1. In this manner, the CPU 61 controls operations of the paper fee position moving unit 4, the head driver 50, and the recovery unit 70 and controls execution of various processes such as the printing process, the ejection abnormality detecting process, and the recovery process. Further, respective constituent elements of the control unit 6 are electrically connected to one another through a bus (not illustrated).

The head driver 50 includes a driving signal generation unit 51, an ejection abnormality detection unit 52, and a switching unit 53.

The driving signal generation unit 51 generates a driving signal Vin for driving the ejection unit 35 included in the head unit 30 based on the print signal SI and the driving waveform signal Com supplied from the control unit 6. In addition, details will be described below, but the driving waveform signal Com in the present embodiment includes three signals of driving waveform signals Com-A, Com-B, and Com-C.

Further, the print signal SI and the driving waveform signal Com are collectively referred to as "print control signals." That is, the driving signal generation unit 51 generates the driving signal Vin based on the print control signal.

The ejection abnormality detection unit 52 detects change of the pressure in the ejection unit 35 caused by vibration or the like of the ink in the ejection unit 35 which is generated after the ejection unit 35 is driven by the driving signal Vin as the residual vibration signal Vout, determines whether the ejection unit 35 has the ejection abnormality and an ejection state of the ink in the ejection unit 35, and outputs the determination result as a determination result signal Rs based on the residual vibration signal Vout.

The switching unit 53 allows respective ejection units 35 to connect to any one of the driving signal generation unit 51 or the ejection abnormality detection unit 52 based on the switching control signal Sw supplied from the control unit 6.

The paper feed position moving unit 4 includes a carriage motor 41 for moving the head unit 30 (more accurately, for moving a carriage 32 on which the head unit 30 is mounted), a carriage motor driver 401 for driving the carriage motor 41, a paper feed motor 42 for transporting the recorded medium, and a paper feed motor driver 402 for driving the paper feed motor 42. In addition, the carriage motor driver 401 and the paper feed motor driver 402 are collectively referred to as a motor driver 40 in some cases.

Figure 2:
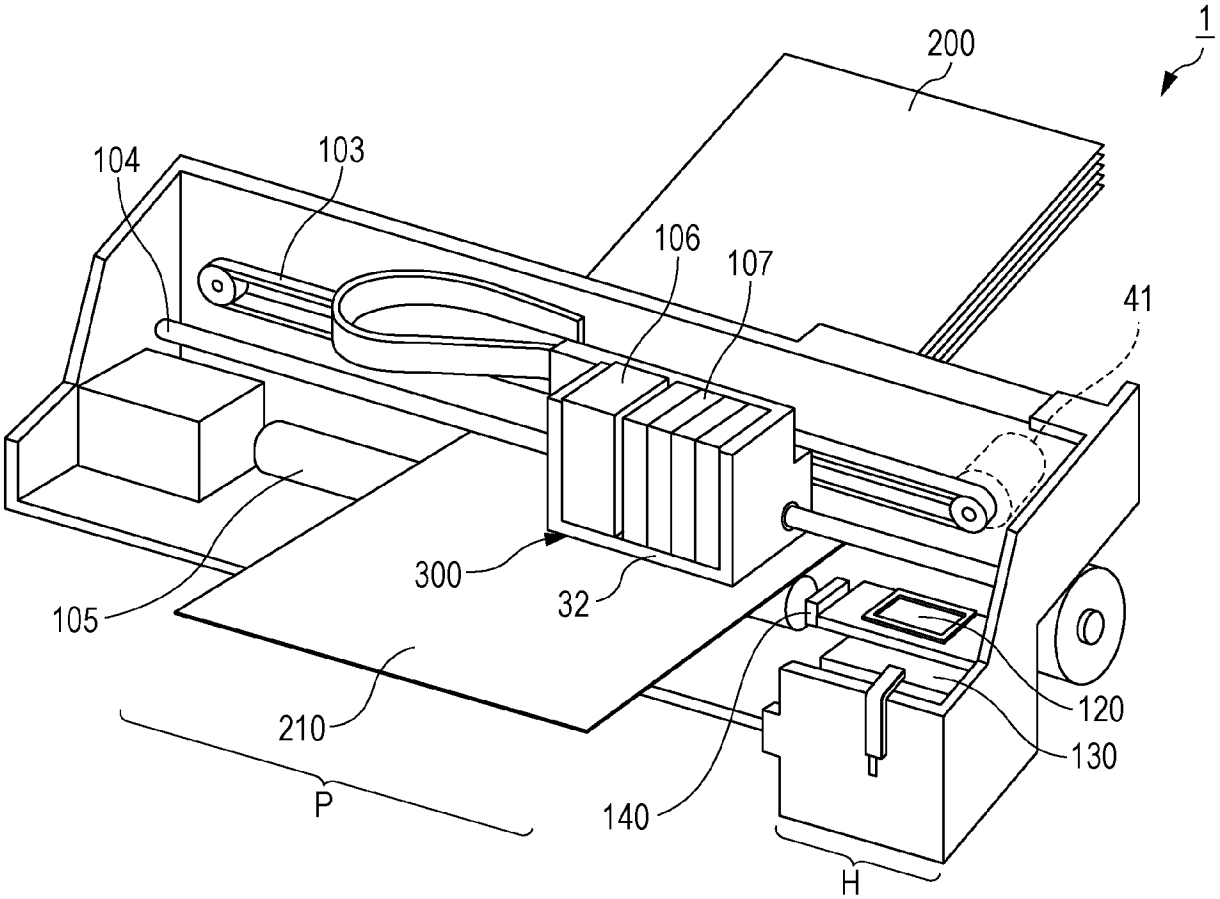
FIG. 2 is a view schematically illustrating an external configuration of the ink jet printer.

FIG. 2 is a perspective view schematically illustrating the ink jet printer 1 as a recording device according to the first embodiment. As illustrated in FIG. 2, the ink jet printer 1 includes the carriage 32. The carriage 32 is guided by a guiding member 104 through a timing belt 103 driven by the carriage motor 41 and reciprocates in an axial direction of a platen 105. A recorded medium (in the present example, paper for recording) 200 is transferred toward between the carriage 32 and the platen 105 by a transport mechanism (not illustrated).

An ink jet recording head 300 is mounted on a position facing the recorded medium 200 of the carriage 32. In addition, a white ink cartridge 106 in which a white ink is accommodated as an ink composition for background which supplies an ink as a liquid to the upside of the ink jet recording head 300 and a color and black ink cartridge 107 in which a color and black ink is accommodated as a colored ink composition are detachably loaded on the ink jet recording head 300. The recorded medium 200 is arranged in a printing area P, the ink is ejected by the ink jet recording head 300, and characters, images, and the like are recorded. The recorded medium 200 on which characters, images, and the like are recorded are discharged as a recorded material 210.

The "white ink" in the present specification means an ink which can be printed using a color referred to as "white" under socially accepted conventions (or a material referred to as an "ink", the same applies hereinafter), and contains a slightly colored ink. Further, an ink containing the pigment, which is referred to as a "white ink" and sold with that name is also included.

Further, the "white ink" includes an ink satisfying relationships of $70 \leq L^* \leq 100$, $-4.5 \leq a^* \leq 2$, and $-6 \leq b^* \leq 2.5$ in a case where brightness (L*) and chromaticity (a*, b*) of the ink are measured under the conditions in which a light source, field of view, concentration, a white reference, a filter, and a measurement mode are respectively set as D50, 2°, DIN NB, Abs, No, and Reflectance using a spectrophotometer Spectrolino (trade name, manufactured by GretagMacbeth) when the ink is used for recording on "Epson genuine photo paper <gloss>" (manufactured by Seiko Epson Corporation) with 100% duty or more or in an amount in which the surface of the photo paper is sufficiently coated.

In addition, the white ink in the present embodiment is used for recording an image on a recording medium (for example, plastic or metal) which is not limited to a white color in some cases. In such a case, the white ink is used to form a base layer for decolorizing the recording medium or degrading transparency of the color image. Further, the white ink according to the present embodiment may be used for a white recording medium, but not limited thereto.

Further, as illustrated in FIG. 2, a capping unit 120 covering an outlet of a nozzle (described below), a suction pump 130 performing a pumping process (suctioning an ink in a cavity (described below) and then discharging the ink), and a wiping member 140 performing a wiping process (wiping foreign materials such as paper dust adhered to the vicinity of the outlet of the nozzle) are arranged on, for example, a home position H which is a non-printing area in which the recorded medium 200 is not arranged.

Figure 3A:
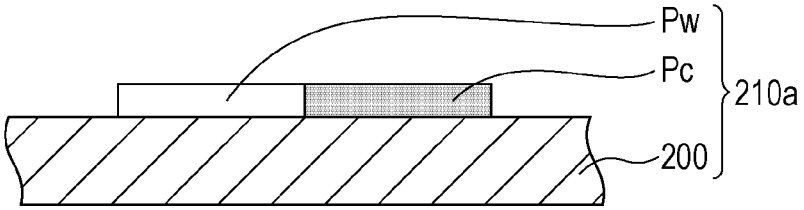
FIG. 3A is a view illustrating a recorded material which is formed in a first mode.
Figure 3B:
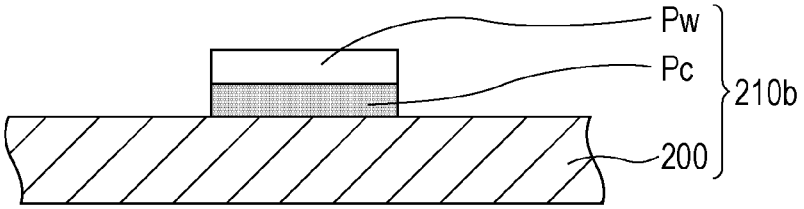
FIG. 3B is a view illustrating a recorded material which is formed in a second mode.
Figure 3C:
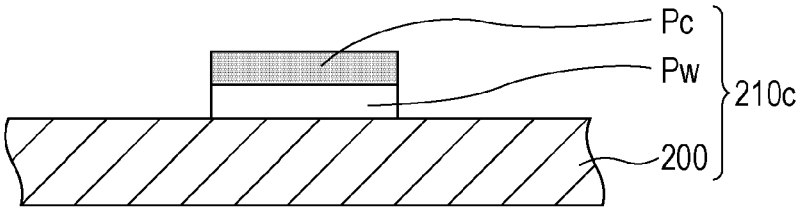
FIG. 3C is a view illustrating a recorded material which is formed in a third mode.

Hereinafter, an outline of a method of recording on the recorded medium 200 using the ink jet printer 1 according to the present embodiment will be described. The ink jet printer 1 includes recording modes of a first mode in which a recorded material 210*a* illustrated in FIG. 3A is formed, a second mode in which a recorded material 210*b* illustrated in FIG. 3B is formed, and a third mode in which a recorded material 210*c* illustrated in FIG. 3C is formed. Here, the "recorded material" means the recorded medium 200 which is recorded by printing or the like.

In the recorded material 210*a* illustrated in FIG. 3A, a white image Pw is formed adjacently to a color image Pc on the recorded medium 200. In the recorded material 210*b* illustrated in FIG. 3B, the color image Pc is formed on the recorded medium 200 and the white image Pw is formed by being overlapped on the color image Pc. In the recorded material 210*c* illustrated in FIG. 3C, the white image Pw is formed on the recorded medium 200 and the color image Pc is formed by being overlapped on the white image Pw.

The recording method using the ink jet printer 1 includes a recording mode selecting step of selecting a recording mode, a first recording step of firstly forming a recorded image based on the selected recording mode, a drying step of drying the image formed by the first recording step, and a second recording step of forming a next recorded image based on the recording mode selected after the drying step.

Recording Mode Selecting Step

The recording mode selecting step is a method of selecting any one of the first mode, the second mode, and the third mode and designating the selected mode as a recording mode by an operation unit (not illustrated) included in the ink jet printer 1 or the recording mode is selected and designated using a method of designating the selected mode as the recording mode by a personal computer (not illustrated) connected to the ink jet printer 1.

First Recording Step

An image is formed and recorded on the recorded medium 200 using a predetermined ink with an ink jet method based on the recording mode selected by the recording mode selecting step. In the first recording step in a case where the first mode or the third mode is selected, the white image Pw is formed as an example of a background image (hereinafter, the white image Pw will be described as an example of the background image). The recorded medium 200 is preferably a kind selected from coated paper such as actual printing paper, polyethylene terephthalate, polyethylene, polypropylene, polyvinyl chloride, a metal, and glass. These recorded mediums 200 are non-ink-absorbent or low-ink-absorbent, and an amount of water absorption from the start of contact to 30 m/sec is 1 $mL/m^2$ or less based on a Bristow method.

It is preferable that the background ink is substantially free of alkyl polyol having a boiling point of 280° C. or higher which is equivalent to one atmospheric pressure. For example, the background ink may contain propylene glycol having a boiling point of 188° C. which is equivalent to one atmospheric pressure, but do not contain glycerin having a boiling point of 280° C. or higher which is equivalent to one atmospheric pressure, polyethylene glycol having a boiling point of 280° C. or higher which is equivalent to 1 atmospheric pressure, and polypropylene glycol having a boiling point of 280° C. or higher which is equivalent to one atmospheric pressure. Further, the background ink is not particularly limited as long as the ink can be used for background, but a white ink or a photoluminescent ink is preferable. As a white pigment contained in the white ink, a pigment containing titanium oxide, zinc oxide, zirconia oxide, and fine particles of hollow resin particles can be used. Here, it is preferable to contain fine particles of titanium oxide from a viewpoint of excellent whiteness. The average particle size of the white pigment, which is not particularly limited, is preferably in the range of 100 nm to 1 μm, more preferably in the range of 200 nm to 400 nm, still more preferably in the range of 250 nm to 380 nm, and most preferably in the range of 260 nm to 350 nm. In addition, the fine particles may be fine particles which are coated with silicon oxide or alumina.

The photoluminescent ink contains a photoluminescent pigment. Examples of the photoluminescent pigment, which is not particularly limited as long as the pigment has photoluminescence when adhered to a medium, include an alloy (also referred to as a metal pigment) of one or more kinds selected from a group consisting of aluminum, silver, gold, platinum, nickel, chrome, tin, zinc, indium, titanium, and copper and a pearl pigment having pearl gloss. Typical examples of the pearl pigment include a pigment having interference gloss or pearl gloss such as titanium dioxide-coated mica, argentine, or bismuth oxychloride.

In addition, as the pigment for background, a pigment having a sedimentation velocity v of $2.0\times10^{-6}$ (cm/s) or more which can be obtained by a "stokes equation" represented by Expression 1 below. The pigment for background having a high sedimentation velocity calculated by the stokes equation may blur on a base image during the second mode. However, according to the invention of the present application, it is possible to excellently prevent such failure.

$$v=\{(\rho-\rho_w)gR^2\}/(18\eta) \quad \text{(Expression 1)}$$

In Expression 1 above, v represents the sedimentation velocity (cm/s), ρ represents the density (g/cm$^3$) of the pigment, ρw represents the density (g/cm$^3$) of a solvent at 20° C., g represents a gravitational acceleration (m/s$^2$), R represents an average particle size (cm) on a volume basis calculated by a dynamic light scattering method of the pigment, and η represents a viscosity (Pa·s) of the solvent at 20° C.

The white image Pw recorded in the first recording step may be a solid image to be formed on the recorded medium 200 and the white image Pw may be formed by aligned to a position in which an image colored by a color ink or a black ink is formed. For obtaining sufficient visibility of the colored image recorded on the white image Pw, the white image Pw formed using the white ink has a whiteness of 73 or more and preferably 75 or more. Here, the amount of the white pigment used for recording of a background image (in the present embodiment, the white image Pw) is preferably 0.8 g/m$^2$ or more and more preferably 1.0 g/m$^2$ or more.

In addition, the surface tension of the white ink is preferably 30 mN/m or less and more preferably 28 mN/m or less. Further, it is preferable that a difference of surface tension between the white ink and the colored ink described below satisfy a relationship of $-5<(S1-S2)<4$ in a case where the surface tension of the white ink as an ink composition for background is set as S1(mN/m) and the surface tension of the colored ink composition is set as S2(mN/m).

In the first recording step of the second mode, the color image Pc is formed by an ink jet method using the colored ink. The colored ink contains a color matter and is substantially free of alkyl polyol having a boiling point of 280° C. or higher which is equivalent to one atmospheric pressure. Here, the surface tension of the colored ink is preferably 30 mN/m or less, more preferably 28 mN/m or less, still more preferably 26 mN/m or less, still more preferably in the range of 10 mN/m to 28 mN/m, and most preferably in the range of 10 mN/m to 26 mN/m.

Drying Step

In the invention, a step of radiating activation energy rays (for example, ultraviolet rays) or a drying step may be provided before the second recording step. In a case where the drying step is provided, the white image Pw or the color image Pc formed in the first recording process is dried in the drying step. As a drying method, natural drying or heating drying may be used. Examples of the heating drying include hot-air drying, heater drying which is dried by a heat source in a direct contact manner, and drying using activation energy rays (for example, infrared rays). Further, the drying step may be carried out with the first recording step at the same time.

In a case of the first recording step of forming the white image Pw, that is the first mode and the third mode, it is preferable drying be performed such that the dryness factor of the white image is in the range of 40% to 90% (preferably in the range of 55% to 90%). Further, in a case of the first recording step of forming the color image Pc, that is the second mode, it is preferable drying be performed such that the dryness factor of the color image Pc is in the range of 40% to 90% (preferably in the range of 55% to 90%). In addition, the dryness factor to be achieved in the drying step may be achieved by the time the colored ink ejected in the second recording step reaches the white image Pw or the color image Pc formed in the first recording step. Accordingly, the drying step is a step taken from when the white image Pw or the color image Pc is recorded on the recorded medium 200 in the first recording step and to when the colored ink or the white ink reaches the white image Pw or the colored image Pc in the second recording step, and the natural drying during the time between the first recording step and the second step is included in the drying step.

The dryness factor can be calculated by the following method. The mass of the recorded medium at the time when an image is formed by applying an ink to the recorded medium corresponds to a dryness factor of 0%. In addition, the time point when the image is dried under a predetermined drying condition and change in mass of the recorded medium is substantially stopped corresponds to a dryness factor of 100%. From these two pieces of data and data (intermediate dryness factor) obtained by changing the drying time, the change in mass and change in dryness factor of the recorded medium can be represented under the same drying conditions. As a result obtained in this manner, the dryness factor can be calculated from the time taken from the image formation with a background color to colored image formation and the mass of the recorded medium at the time of the second recording step. In addition, in a case where the drying temperature is changed from time to time, it is preferable to calculate the dryness factor on the mass basis.

In regard to the drying time in the drying step of the image formed in the first recording step, it is preferable to make the drying time of the white image Pw formed by the first recording step of the third mode and the drying time of the colored image Pc formed by the first recording step of the second mode long. In a case where the white ink forming the white image Pw is overlapped on the colored image Pc formed on the recorded medium 200 in the second recording step of the second mode described below using an ink jet method, bleeding, that is, color mixing or blurring of the white image Pw to the colored image Pc can be suppressed by drying in the above-described manner. Since the pigment for background has a sedimentation velocity which tends to be higher than that of the colored pigment used for the colored ink, the blurring in the second mode tends to be larger than that of the third mode. Accordingly, it is preferable to improve the drying state in the third mode.

Second Recording Step

The color image Pc or the white image Pw is formed with respect to the white image Pw or the color image Pc formed in the first recording step based on the selected recording mode.

In a case where the first mode is selected, the color image Pc is formed so as to be adjacent to the white image Pw as illustrated in FIG. 3A and the recorded material 210*a* can be obtained in the second recording step. In a case where the second mode is selected, the white image Pw is formed by being overlapped on the color image Pc as illustrated in FIG. 3B and the recorded material 210*b* can be obtained in the second recording step. Further, in a case where the third mode is selected, the color image Pc is formed by being overlapped on the white image Pw as illustrated in FIG. 3C and the recorded material 210*c* can be obtained in the second recording step.

Next, the configurations of the head unit 30 and the ejection unit 35 included in the head unit 30 will be described with reference to FIGS. 4 and 5.

Figure 4:
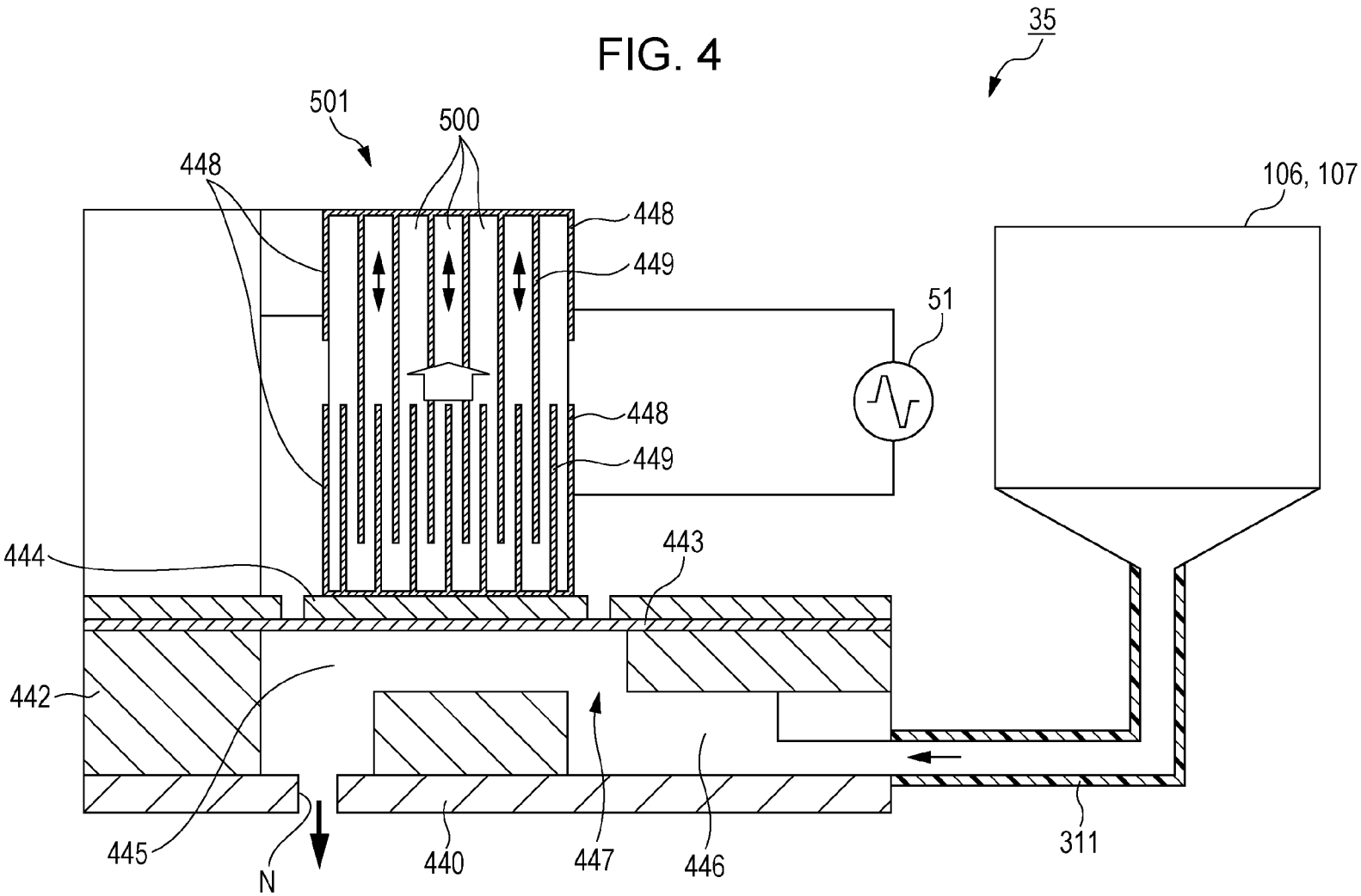
FIG. 4 is a cross-sectional view schematically illustrating respective ejection units included in a head unit.
Figure 5:
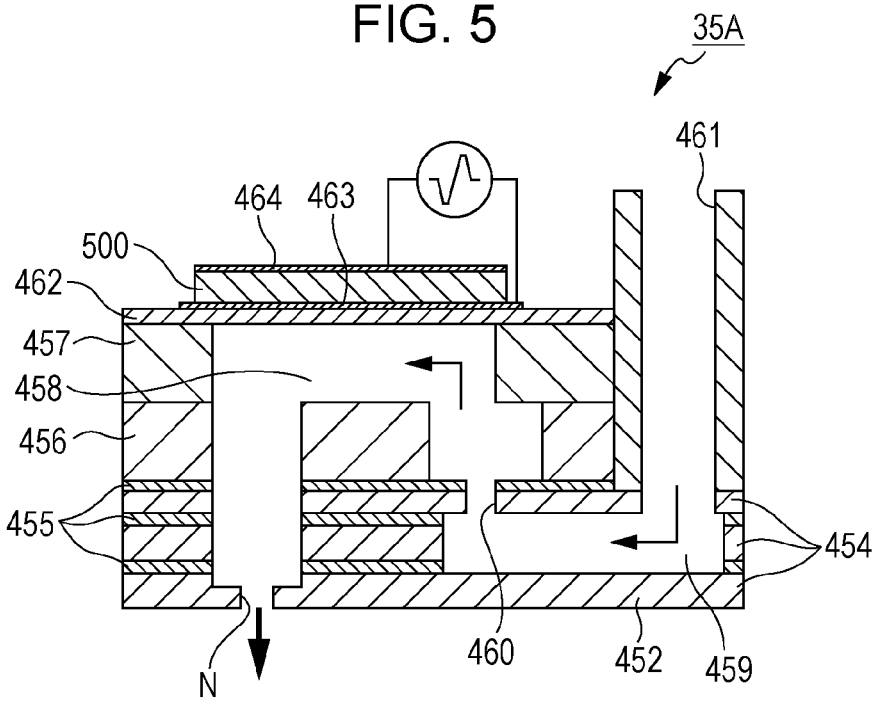
FIG. 5 is a cross-sectional view schematically illustrating respective ejection units included the head unit.

FIG. 4 is a cross-sectional view schematically illustrating respective ejection units 35 included in the head unit 30. The ejection units 35 illustrated in FIG. 4 ejects a liquid (in the present example, an ink) in a cavity 445 from a nozzle N by driving a piezoelectric element 500. Specifically, the ink is ejected from the nozzle N by allowing the voltage (driving signal) applied to the piezoelectric element 500 to be changed with time and allowing the cavity 445 to expand or be contracted (by allowing the volume of the cavity 445 to be changed). The ejection unit 35 includes a nozzle plate 440 on which the nozzle N is formed, a cavity plate 442, a vibrating plate 443, and a laminated piezoelectric element 501 formed by laminating a plurality of piezoelectric elements 500 to each other.

The cavity plate 442 is formed to have a predetermined shape (shape with a concave portion) so that the cavity 445 and a reservoir 446 are formed. The cavity 445 and the reservoir 446 are communicated with each other through an ink supply port 447. Further, the reservoir 446 is communicated with ink cartridges 106 and 107 through an ink supply tube 311.

In FIG. 4, the lower end of the laminated piezoelectric element 501 is bonded to the vibrating plate 443 through an intermediate layer 444. A plurality of external electrodes 448 and internal electrodes 449 are bonded to the laminated piezoelectric element 501. That is, the external electrodes 448 are bonded to the outer surface of the laminated piezoelectric element 501 and the internal electrodes 449 are arranged between the respective piezoelectric elements 500 (or in the inside of the respective piezoelectric elements) constituting the laminated piezoelectric element 501. In this case, a part of the external electrodes 448 and internal electrodes 449 are alternatively arranged so as to be overlapped on the piezoelectric element 500 in the thickness direction.

Further, the laminated piezoelectric element 501 is deformed (expands or is contracted in the vertical direction in FIG. 3) and vibrated as indicated an arrow in FIG. 4 and the vibrating plate 443 is vibrated due to the vibration by applying a driving voltage waveform to between the external electrode 448 and the internal electrode 449 using the driving signal generation unit 51. The volume of the cavity 445 (pressure in the cavity) is changed due to the vibration of the vibrating plate 443 and the ink filled in the cavity 445 is ejected by the nozzle N.

The amount of the liquid reduced in the cavity 445 due to ejection of the liquid is replenished by the ink being supplied from the reservoir 446. Further, the ink is supplied to the reservoir 446 from the ink cartridges 106 and 107 through the supply tube 311.

A pitch between nozzles N formed on the nozzle plate 440 is appropriately set according to print resolution (dpi: dot per inch), and an arrangement pattern of shifting the nozzles N in the main scanning direction and a sub scanning direction can be exemplified as an example of the arrangement pattern.

Next, another example of the ejection unit 35 will be described. In an ejection unit 35A illustrated in FIG. 5, a vibrating plate 462 is vibrated due to driving of the piezoelectric element 500 and an ink (liquid) in a cavity 458 is ejected from the nozzle N. A stainless steel metal plate 454 is bonded to a stainless steel nozzle plate 452 on which the nozzle (hole) N is formed through an adhesive film 455, and the same stainless steel metal plate 454 is bonded thereon through the adhesive film 455. In addition, a communication port forming plate 456 and a cavity plate 457 are subsequently bonded thereon.

The nozzle plate 452, the metal plate 454, the adhesive film 455, the communication port forming plate 456, and the cavity plate 457 are respectively formed to have a predetermined shape (shape with a concave portion) and the cavity 458 and a reservoir 459 are formed by overlapping them to each other. The cavity 458 is communicated with the reservoir 459 through an ink supply port 460. In addition, the reservoir 459 is communicated with an ink intake port 461.

The vibrating plate 462 is disposed in an opening on the upper surface of the cavity plate 457 and the piezoelectric element 500 is bonded to the vibrating plate 462 through a lower electrode 463. Further, an upper electrode 464 is bonded to the opposite side to the lower electrode 463 of the piezoelectric element 500. In the driving signal generation unit 51, the piezoelectric element 500 is vibrated and the vibrating plate 462 bonded to the piezoelectric element 500 is vibrated by applying (supplying) the driving voltage waveform to between the upper electrode 464 and the lower electrode 463. The volume (pressure in the cavity) of the cavity 458 is changed by the vibration of the vibrating plate 462 and the ink (liquid) filled in the cavity 458 is ejected as a liquid from the nozzle N.

The amount of the liquid reduced in the cavity 458 due to ejection of the ink is replenished by the ink being supplied from the reservoir 459. Further, the ink is supplied to the reservoir 459 from the ink intake port 461.

Figure 6A:
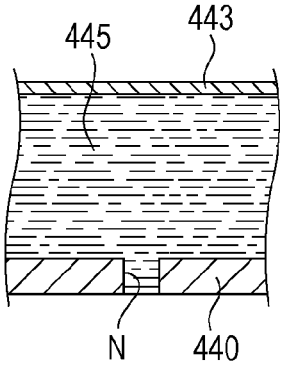
FIGS. 6A to 6C are views illustrating an aspect of ejection of ink droplets.
Figure 6B:
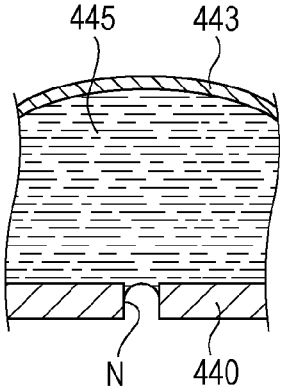
Figure 6C:
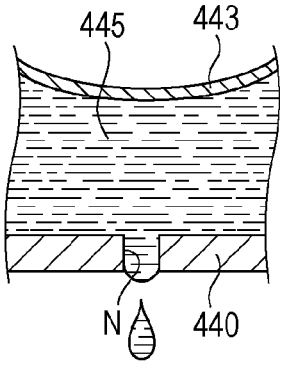

Next, ejection of ink droplets will be described with reference to FIG. 6. When the driving voltage is applied to the piezoelectric element 500 illustrated in FIG. 4 (the same applies to FIG. 5) from the driving signal generation unit 51, a Coulomb force is generated between electrodes, the vibration plate 443 (vibrating plate 462 is FIG. 5: the same applies hereinafter) is bent upward in FIG. 4 (FIG. 5) with respect to an initial state illustrated in FIG. 6A, and the volume of the cavity 445 (cavity 458 in FIG. 5: the same applies hereinafter) expands as illustrated in FIG. 6B. In this state, when the driving voltage is changed by control of the driving signal generation unit 51, the vibrating plate 443 is restored by an elastic restoring force and moves downward over the position of the vibrating plate 443 in the initial state, and the volume of the cavity 445 is drastically contracted as illustrated in FIG. 6C. A part of the ink (liquid material) which fills in the cavity 445 is ejected as ink droplets from the nozzle N communicating with the cavity 445 by a compression pressure generated in the cavity 445 at this time.

The vibration plate 443 of the cavity 445 performs damped vibration integrally with the piezoelectric element 500 after a series of ink ejecting movements are terminated to before next ink ejecting movement is started. Hereinafter, the damped vibration is referred to as residual vibration. The residual vibration of the vibrating plate 443 and the piezoelectric element 500 (hereinafter, simply referred as the residual vibration of the "vibrating plate 443") is assumed to have a natural vibration frequency determined by the shape of the nozzle N or the ink supply port 447 (ink supply port 460 in FIG. 5, the same applies hereinafter), the acoustic resistance r due to the viscosity or the like of the ink, the inertance m due to the weight of the ink in a channel, and the compliance Cm of the vibrating plate 443.

The "channel" of the ink in the present specification means a space where the ink flowing out of an accommodation unit (for example, white ink cartridge 106) of the ink passes until the ink is ejected from the nozzle N. For example, in the ink jet printer 1, for example, the ink supply tube 311 and the ink flow channel in the head unit 30 correspond to the ink channel.

The calculation model of the residual vibration of the vibrating plate 443 will be described based on the above-described assumption.

Figure 7:
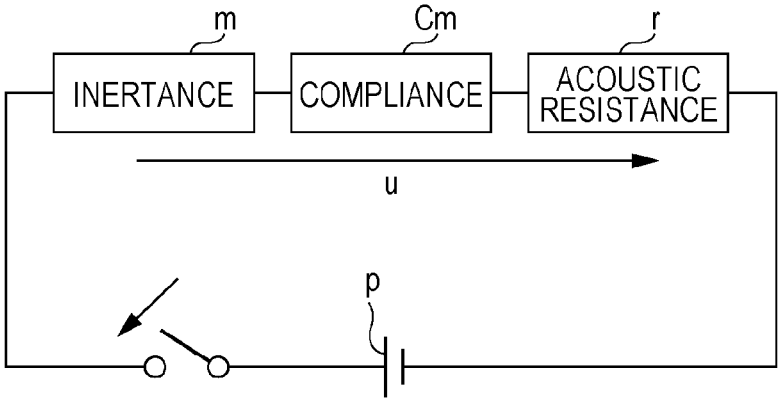
FIG. 7 is a circuit diagram illustrating a calculation model of simple vibration on the assumption of residual vibration of a vibrating plate.

FIG. 7 is a circuit diagram illustrating a calculation model of the simple vibration assuming the residual vibration of the vibrating plate 443. In this manner, the calculation model of the residual vibration of the vibrating plate 443 is represented by the sound pressure p, the above-described inertance m, the compliance Cm, and the acoustic resistance r. Further, when a step response at the time when the sound pressure p is applied to the circuit of FIG. 7 is calculated on the volume velocity V, the following expressions can be obtained.

$$v=\{p/\omega\cdot m\}\}e^{-\omega t}\cdot\sin(\omega t) \quad \text{(Expression 2)}$$

$$\omega=\{1/(m\cdot Cm)-\alpha^2\}^{1/2} \quad \text{(Expression 3)}$$

$$\alpha=r/(2m) \quad \text{(Expression 4)}$$

Figure 8:
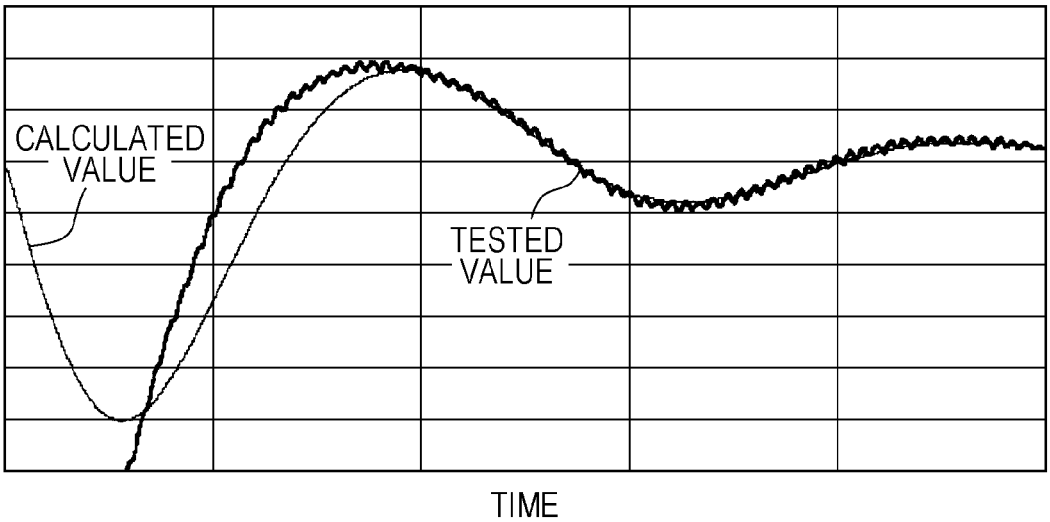
FIG. 8 is a graph illustrating a relationship between test values and calculated values of the residual vibration of the vibrating plate.

The calculated result obtained from the above expression is compared to a test result in the separately performed test of the residual vibration of the vibrating plate 443 after the ink droplets are ejected. FIG. 8 is a graph illustrating the relationship between the test result and the calculated result of the vibrating plate 443. As understood from the graph in FIG. 8, two waveforms of the tested value and the calculated value approximately coincide with each other.

In the ejection unit 35, a phenomenon in which ink droplets are not normally ejected from the nozzle N despite the fact that the above-described ejection operation have been performed, that is, ejection abnormality of the liquid occurs in some cases. The causes of ejection abnormality occurring are, for example, sedimentation of the pigment component of the ink (first cause) thickening (increased viscosity due to dryness) of the ink in the vicinity of the nozzle N (second cause), and adhesion of paper dust to the vicinity of the outlet of the nozzle N (third cause).

When the ejection abnormality occurs, as a typical result, the liquid is not ejected from the nozzle N, that is, a non-ejection phenomenon of the liquid appears, and dot omission of pixels in an image printed on the recorded medium 200 is generated in this case. Further, in the case of ejection failure, even when the liquid is ejected from the nozzle N, since the amount of the liquid is extremely small or the liquid is not properly landed because the flight direction (trajectory) of the liquid is shifted or the like, the dot omission of pixels appears. From this cause, in the description below, the ejection abnormality of the liquid is also simply referred to as "dot omission."

Hereinafter, based on the comparison result illustrated in FIG. 8, at least one value of the acoustic resistance r and the inertance m is adjusted such that the calculated value and the test value of the residual vibration of the vibrating plate 443 coincide with each other for each cause of the ejection abnormality at the time of the printing process which is generated in the ejection unit 35.

Figure 9A:
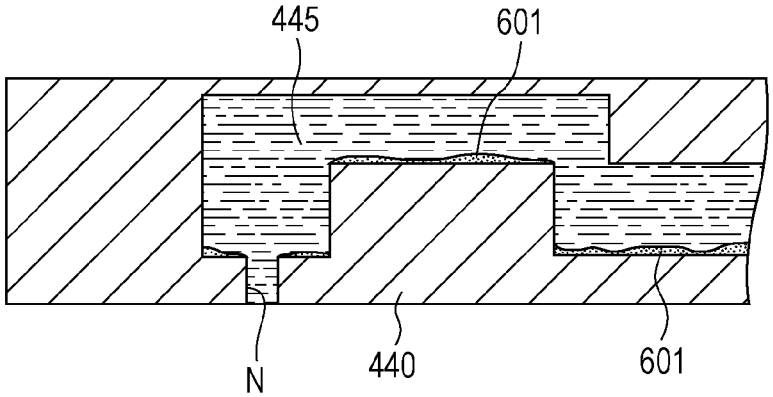
FIGS. 9A and 9B are views illustrating a concept of sedimentation of a pigment component of an ink in a cavity.
Figure 9B:
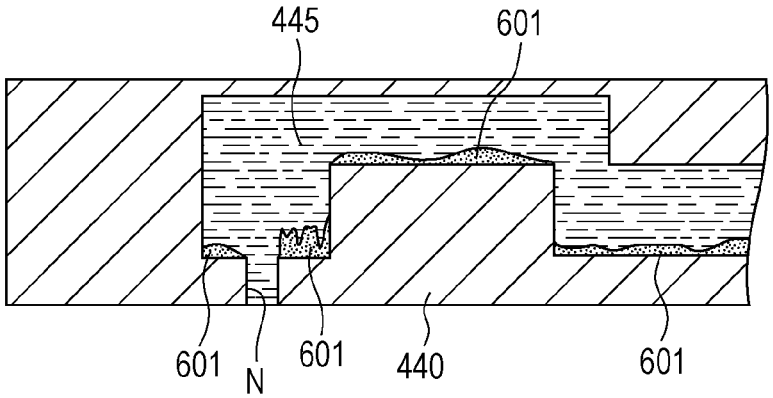

FIGS. 9A and 9B are conceptual views of sedimentation of the pigment component of the ink in the cavity 445, the reservoir 446, and the ink supply port 447. First, the sedimentation of the pigment component of the ink in the cavity 445 (first cause) which is a cause of the ejection failure will be examined.

In the present specification, the states generated by the sedimentation of the pigment component of the ink are classified into two states. One state (hereinafter, referred to as "first sedimentation state") is a state illustrated in FIG. 9A, and is a state in which the pigment component of the ink is mainly settled (further, aggregation or solidification) in an area separated from the nozzle N and sedimentation to a degree that the volume in the cavity 445 is substantially decreased is does not occur in the vicinity of the nozzle N. In this state, the ink whose concentration of the pigment component becomes low reaches the vicinity of the nozzle N.

Another state (hereinafter, referred to as "second sedimentation state") is a state illustrated in FIG. 9B and is a state in which sedimentation (further, aggregation or solidification) of the pigment component of the ink occurs to a degree that the volume in the cavity 445 is substantially decreased even in the vicinity of the nozzle N.

In the first sedimentation state illustrated in FIG. 9A, it is considered that the weight of the ink in the channel is decreased and the inertance m is decreased since the weight of the ink is decreased by the weight of the aggregated and solidified pigment component. Accordingly, when the inertance m is set to be small and is matched with the test value of the residual vibration at the time of the first sedimentation with respect to a case in which the ink is normally ejected illustrated in FIG. 8, a characteristic residual vibration waveform whose frequency becomes higher (the cycle T becomes shorter) compared to that at the time of normal ejection can be obtained. That is, the residual vibration waveform at the time of the first sedimentation state becomes a waveform whose frequency T is small compared to that at the time of normal ejection.

In the second sedimentation state illustrated in FIG. 9B, the inertance m is decreased similarly to the first sedimentation state is generated and the frequency becomes higher (the cycle T becomes shorter) compared to that at the time of normal ejection. In addition, at the time of the second sedimentation state, it is considered that the acoustic resistance r is increased because the diameter of the nozzle N becomes smaller due to the pigment component which is aggregated and solidified in the vicinity of the nozzle N. Because of the decreased acoustic resistance r, the damping factor of the amplitude of the residual vibration waveform is decreased and the residual vibration slowly decreases the amplitude.

Further, since the pigment component which is settled and then aggregated and solidified narrows the channel in the cavity 445, the volume in the cavity 445 is substantially decreased. It is considered that amplitude A of the residual vibration waveform becomes small due to decrease in volume in the cavity 445. That is, the residual vibration waveform at the time of the second sedimentation state becomes a waveform whose cycle T becomes shorter and the amplitude A is small compared to those at the time of normal ejection.

Next, thickening of the ink in the vicinity of the nozzle N (second cause) which is another cause of the ejection abnormality will be examined. In a case where the ink is thickened in the vicinity of the nozzle N, the ink in the cavity 445 is shut in the cavity 445. Specifically, as a state of the ink being thickened in the present example, a state in which the ink cannot be ejected (state in which the ink is fixed to the vicinity of the nozzle N) because the ejection unit 35 is left as it is in a state of not installing the capping unit 120 for several days and the ink is thickened due to dryness of the ink in the vicinity of the nozzle N is assumed.

In a case where the ink is thickened in the vicinity of the nozzle N in this manner, it is considered that the acoustic resistance r is increased. The characteristic residual vibration waveform whose frequency becomes extremely lower compared to that at the time of normal ejection and residual vibration is over-damped can be obtained by setting the acoustic resistance r to be large and matching the acoustic resistance r with the test value of the residual vibration at the time of the ink being thickened (dried or fixed) in the vicinity of the nozzle N with respect to a case in which the ink is normally ejected illustrated in FIG. 8.

This is because the ink has no way out of the cavity 445 when the vibrating plate 443 is moved upward in FIG. 4 after the ink flows in the cavity 445 from the reservoir 446 by the vibrating plate 443 being drawn downward in FIG. 4 for ejecting the ink droplets and thus the vibrating plate 443 cannot be rapidly vibrated (over-damped).

Next, adhesion of paper dust to the vicinity of the outlet of the nozzle N (third cause) which is another cause of the ejection failure will be examined. In a case where paper dust is adhered to the vicinity of the outlet of the nozzle N, the ink oozes from the cavity 445 through the paper dust and cannot be ejected from the nozzle N. In this manner, in the case where the paper dust is adhered to the vicinity of the outlet of the nozzle N and the ink oozes from the nozzle N, it is considered that the inertance m is increased because the ink in the cavity 445 and the oozing ink are increased more than normal when seen from the vibration plate 443. In addition, it is considered that the acoustic resistance r is increased by fibers of paper dust adhered to the vicinity of the outlet of the nozzle N.

Therefore, the characteristic residual vibration waveform whose frequency becomes lower compared to that at the time of normal ejection by setting the inertance m and the acoustic resistance r to be large and matching the values with the test values of the residual vibration at the time of the paper dust being adhered to the vicinity of the outlet of the nozzle N with respect to the case in which the ink is normally ejected illustrated in FIG. 8. Here, in the case of adhesion of the paper dust, the frequency of the residual vibration becomes higher (the cycle T is shorter) compared to the case where the ink is thickened.

The ink jet printer 1 according to the present embodiment detects ejection failure of the respective ejection units 35 based on the cycle T of the residual vibration of the vibrating plate 443 when the ink droplets of the nozzle N in the respective ejection units 35 are ejected. In addition, the causes of the ejection abnormality are specified based on the cycle T and the amplitude A. That is, the ink jet printer 1 according to the present embodiment analyzes the residual vibration and specifies the ejection abnormality and the causes thereof.

Hereinafter, the configuration and the operation of the head driver 50 (the driving signal generation unit 51, the ejection abnormality detection unit 52, and the switching unit 53) will be described.

Figures 10, 11:
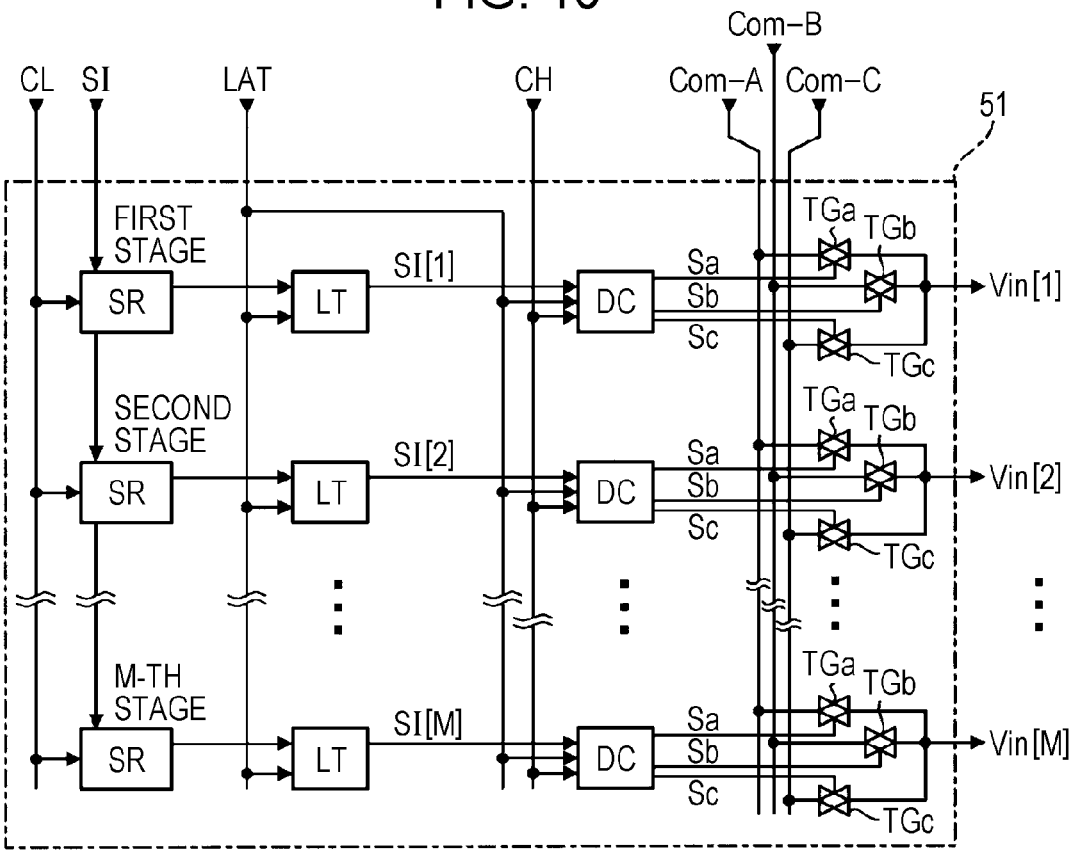
FIG. 10 is a block diagram illustrating a configuration of a driving signal generation unit in a head driver.
FIG. 11 is a view illustrating contents of decoding performed by a decoder.

FIG. 10 is a block diagram illustrating the configuration of the driving signal generation unit 51 in the head driver 50. As illustrated in the same figure, the driving signal generation unit 51 includes M groups which respectively consists of a shift register SR, a latch circuit LT, a decoder DC, a transmission gate TGa, TGb, and TGc so as to be in one-to-one correspondence with the M ejection units 35. Hereinafter, respective elements constituting these M groups are referred to as a first stage, a second stage, . . . , and an M stage in order from the upside in the figure.

Moreover, the ejection abnormality detection unit includes M ejection abnormality detection circuits DT (DT[1], DT[2], . . . , DT[M]) so as to be in one-to-one-correspondence with the M ejection units 35, but details will be described below.

A clock signal CL, a print signal SI, a latch signal LAT, a change signal CH, and driving waveform signals Com (Com-A, Com-B, and Com-C) are supplied to the driving signal generation unit 51 from the control unit 6.

Here, the print signal SI is a digital signal which prescribes the amount of the ink to be ejected from the respective ejection units 35 (respective nozzles N) when one dot of an image is formed. More specifically, the print signal SI according to the present embodiment prescribes the amount of the ink to be ejected from the respective ejection units 35 (respective nozzles N) by three bits of a high-order bit b1, a middle-order bit b2, and a low-order bit b3, and synchronizes with the clock signal CL to be serially supplied to the driving signal generation unit 51 from the control unit 6. Four gradations of non-recording, small dots, medium dots, and large dots can be expressed in respective dots of the recorded medium 200 by controlling the amount of the ink to be ejected from the respective ejection units 35 by this print signal SI, and the driving signal for inspection which is used for allowing the residual vibration to occur and inspecting the ejection state of the ink can be generated.

Respective shift registers SR temporarily hold the print signals SI for every 3 bits corresponding to the respective ejection units 35. Specifically, the M shift registers SR in the first stage, second stage, . . ., M-th stage in one-to-one correspondence with the M ejection units are connected to each other in cascade and the print signals SI are sequentially transferred to the next stage according to the clock signal CL. Further, when the print signals SI are transferred to all of M shift registers SR, a state in which the clock signal CL is stopped to be supplied and each of the M shift registers SR holds 3-bit data corresponding to the print signals is maintained.

Figure 15:
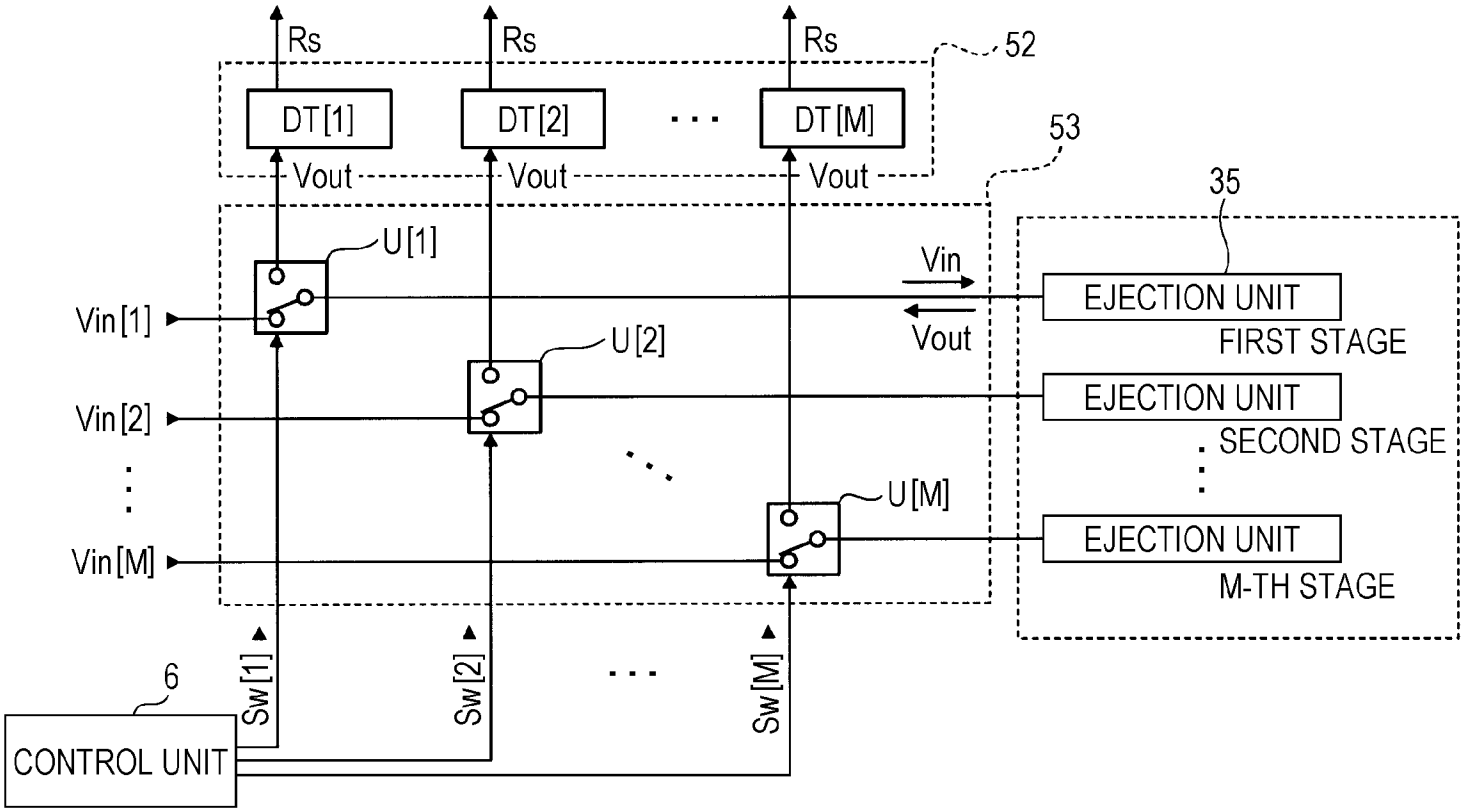
FIG. 15 is a block diagram illustrating a configuration of a head driver.

Each of the M latch circuits LT simultaneously latches the 3-bit print signals SI corresponding to respective stages, which are held in each of M shift registers SR at a timing of a latch signal LAT being started. In FIG. 15, each of SI[1], SI[2], . . . , SI[M] indicates 3-bit print signals SI which are respectively latched by the latch circuit LT corresponding to the first stage, second stage, . . . , M-th stage of shift registers SR.

On the other hand, a print operation period which is a period when the ink jet printer 1 forms an image on the recorded medium 200 and prints the image is formed of a plurality of unit operation periods Tu.

The control unit 6 assigns the unit operation periods Tu to the printing process or the ejection abnormality detecting process on each of the M ejection units 35. The control unit 6 controls the ejection unit 35 with three aspects. In a first aspect, the printing process is assigned to a part of the M ejection units 35 and the ejection abnormality detecting process is assigned to other units. In a second aspect, the printing process is assigned to all of the M ejection units 35. In a third aspect, the ejection abnormality detecting process is assigned to all of the M ejection units 35.

The unit operation period Tu is formed of a control period Tc1 and a control period Tc2 subsequent to the control period Tc1. In the present embodiment, the control periods Tc1 and Tc2 have an equal length of time.

The control unit 6 supplies the print signals SI for every unit operation period Tu with respect to the driving signal generation unit 51 and the latch circuit LT latches the print signals SI[1], SI[2], . . . , SI[M] for every unit operation period Tu.

A decoder DC decodes 3-bit print signals SI latched by the latch circuit LT and outputs selection signals Sa, Sb, and Sc in the respective control periods Tc1 and Tc2.

FIG. 11 is an explanation view (table) illustrating the contents of decoding performed by the decoder DC. As illustrated in the figure, in a case where the content indicated by the print signals SI [m] corresponding to the m-th stage (m is a natural number satisfying a relationship of $1 \leq m \leq M$) is, for example, (b1, b2, b3)=(1, 0, 0), the decoder DC in the m-th stage sets the selection signal Sa to a high level H and sets the selection signals Sb and Sc to a low level L in the control period Tc1, and the decoder DC in the m-th stage sets the selection signals Sa and Sc to the low level L and sets the selection signal Sb to a high level H in the control period Tc2.

Further, in a case where the low-order bit b3 is "1", the decoder DC in the m-th stage sets the selection signals Sa and Sb to the low level L and the selection signal Sc to the high level H in the control periods Tc1 and Tc2 regardless of values of the high-order bit b1 and middle-order bit b2.

The description is returned to FIG. 10. As illustrated in the same figure, the driving signal generation unit 51 includes a group consisting of M transmittance gates TGa and TGb so as to be in one-to-one correspondence with the M ejection units 35.

The transmittance gate TGa is turned on when the selection signal Sa is in the high level H and is turned off when the selection signal Sa is in the low level L. The transmittance gate TGb is turned on when the selection signal Sb is in the high level H and is turned off when the selection signal Sb is in the low level L. The transmittance gate TGc is turned on when the selection signal Sc is in the high level H and is turned off when the selection signal Sc is in the low level L.

For example, in the m-th stage, in a case where the content indicated by the print signal SI[m] is (b1, b2, b3)=(1, 0, 0), the transmittance gate TGa is turned on and the transmittance gates TGb and TGc are tuned off in the control period Tc1, and the transmittance gates TGa and TGc are turned on and the transmittance gate TGb is tuned off in the control period Tc2.

The driving waveform signal Com-A is supplied to one end of the transmittance gate TGa, the driving waveform signal Com-B is supplied to one end of the transmittance gate TGb, and the driving waveform signal Com-C is supplied to one end of the transmittance gate TGc. In addition, another ends of the transmittance gates TGa, TGb, and TGc are connected to one another.

The transmittance gates TGa, TGb, and TGc are exclusively turned on, the driving waveform signal Com-A, Com-B, or Com-C selected by respective control periods Tc1 and Tc2 is output as the driving signal Vin[m] and the output signal is supplied to the ejection unit 35 in the m-th stage through the switching unit 53.

Figure 12:
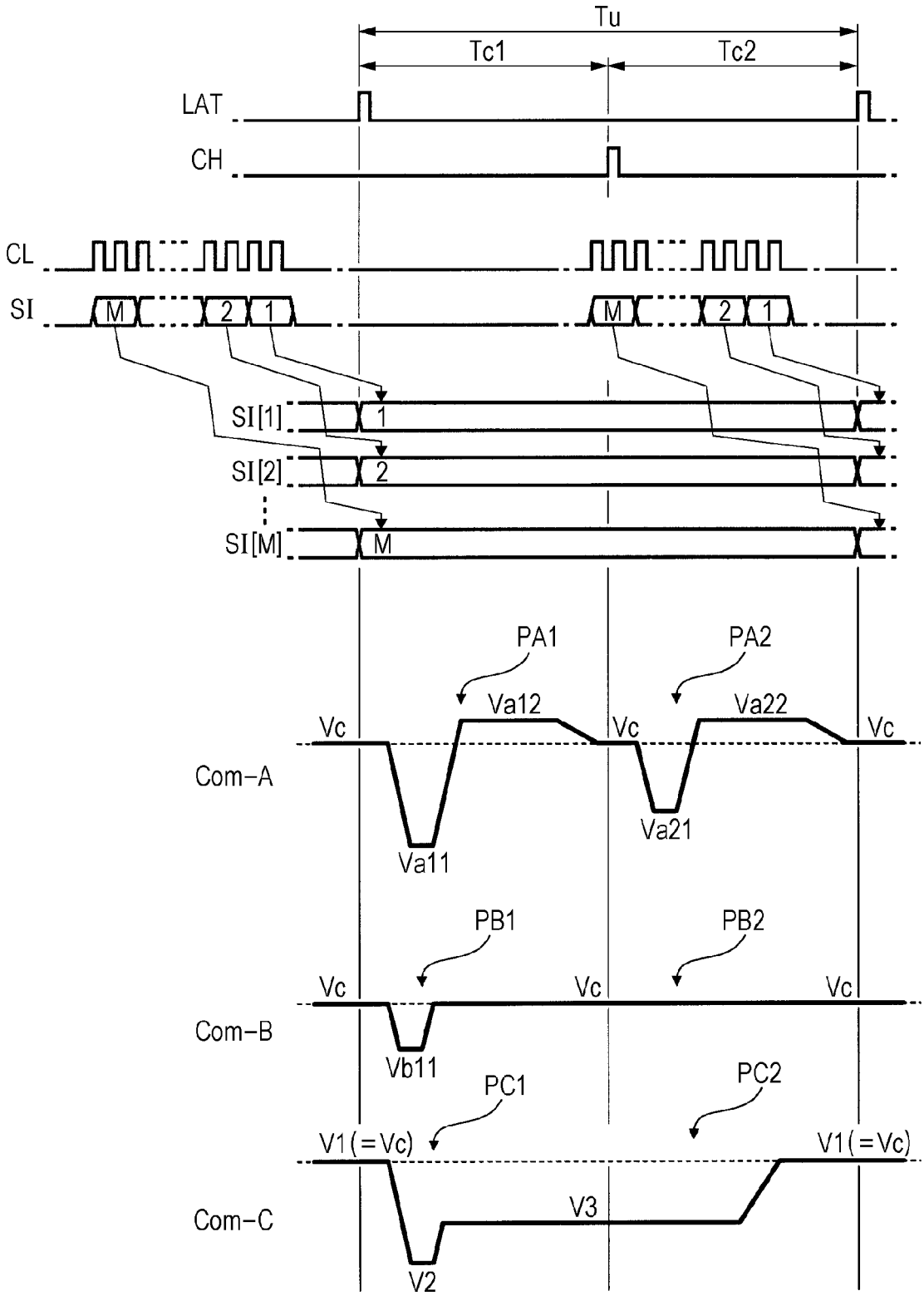
FIG. 12 is a view illustrating a timing chart for describing an operation of the driving signal generation unit in a unit operation period.

FIG. 12 is a timinig chart for describing the operation of the driving signal generation unit 51 in the unit operation period Tu. As illustrated in the same figure, the unit operation period Tu is prescribed by the latch signal LAT output by the control unit 6. In addition, the respective unit operation periods Tu are formed of the control periods Tc1 and Tc2 having an equal length of time, which are prescribed by the latch signal LAT and a change signal CH.

As illustrated in the same figure, the driving waveform signal Com-A supplied from the control unit 6 in the unit operation period Tu is a waveform which allows a unit waveform PA1 arranged in the control period Tc1 and a unit waveform PA2 arranged in the control period Tc2 among the unit operation periods Tu to be continuous. The potential in the timing of start and end of the unit waveforms PA1 and PA2 is a reference potential Vc in both cases. Further, as illustrated in the figure, a potential difference between a potential Va11 and a potential Va12 of the unit waveform PA1 is larger than the potential difference between a potential Va21 and a potential Va22 of the unit waveform PA2. Accordingly, the amount of the ink ejected from the nozzle N included in the respective ejection units 35 in a case where the piezoelectric element 500 included in the respective ejection units 35 is driven by the unit waveform PA1 is larger than that of the ink ejected in a case where the piezoelectric element 500 is driven by the unit waveform PA2.

The driving waveform signal Com-B supplied from the control unit 6 in the unit operation period Tu is a waveform which allows a unit waveform PB1 arranged in the control period Tc1 and a unit waveform PB2 arranged in the control period Tc2 to be continuous. The potential in the timing of start and end of the unit waveform PB1 is the reference potential Vc in both cases, and the unit waveform PB2 is maintained at the reference potential Vc over the control period Tc2. In addition, the potential difference between the reference potential Vc and a potential Vb11 of the unit waveform PB1 is smaller than the potential difference between the potential Va21 and the potential Va22 of the unit waveform PA2. In addition, the ink is not ejected from the nozzle N included in the respective ejection units 35 even when the piezoelectric element 500 included in the respective ejection units 35 is driven by the unit waveform PB1. Similarly, even when the unit waveform PB2 is supplied to the piezoelectric element 500, the ink is not ejected from the nozzle N.

The driving waveform signal Com-C supplied from the control unit 6 in the unit operation period Tu is a waveform which allows a unit waveform PC1 arranged in the control period Tc1 and a unit waveform PC2 arranged in the control period Tc2 to be continuous. The potential in the timing of the start of the unit waveform PB1 and the end of the unit waveform PB2 is a first potential V1 in both cases (in this example, the reference potential Vc). The unit waveform PB1 is moved from the first potential V1 to a second potential V2 and moved from the second potential V2 to a third potential V3, and then is held by the third potential V3. In addition, the unit waveform PB2 holds the third voltage V3, is moved from the third potential V3 to the first potential V1, and then is held by the first potential V1. The driving waveform signal Com-C is selected when the ejection state of the ink is inspected. Further, the first potential (reference potential Vc) of the example is set to a potential to be held by the piezoelectric element 500 at the time of non-ejection of the ink.

As described above, the M latch circuits LT output the print signals SI[1], SI[2], . . . , SI[M] at the timing of the latch signal LAT being started, that is, the timing of the unit operation period Tu (Tp or Tt) being started.

Figure 16:
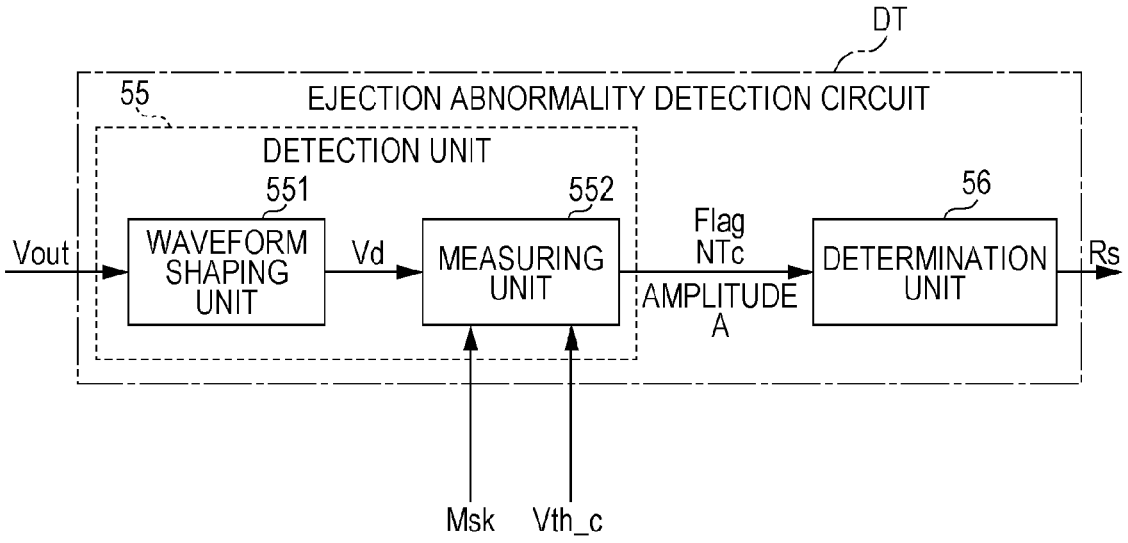
FIG. 16 is a block diagram illustrating a configuration of an ejection abnormality detection circuit.

In addition, the decoder DC in the m-th stage outputs the selection signals Sa, Sb, and Sc based on the contents of the table illustrated in FIG. 16 in the respective control periods Tc1 and Tc2 according to the print signal SI[m] as described above.

Further, the transmission gates TGa, TGb, and TGc in the m-th stage select any one of the driving waveform signals Com-A, Com-B, and Com-C based on the selection signals Sa, Sb, and Sc as described above, and output the selected driving waveform signal Com as the driving signal Vin[m].

Figure 13:
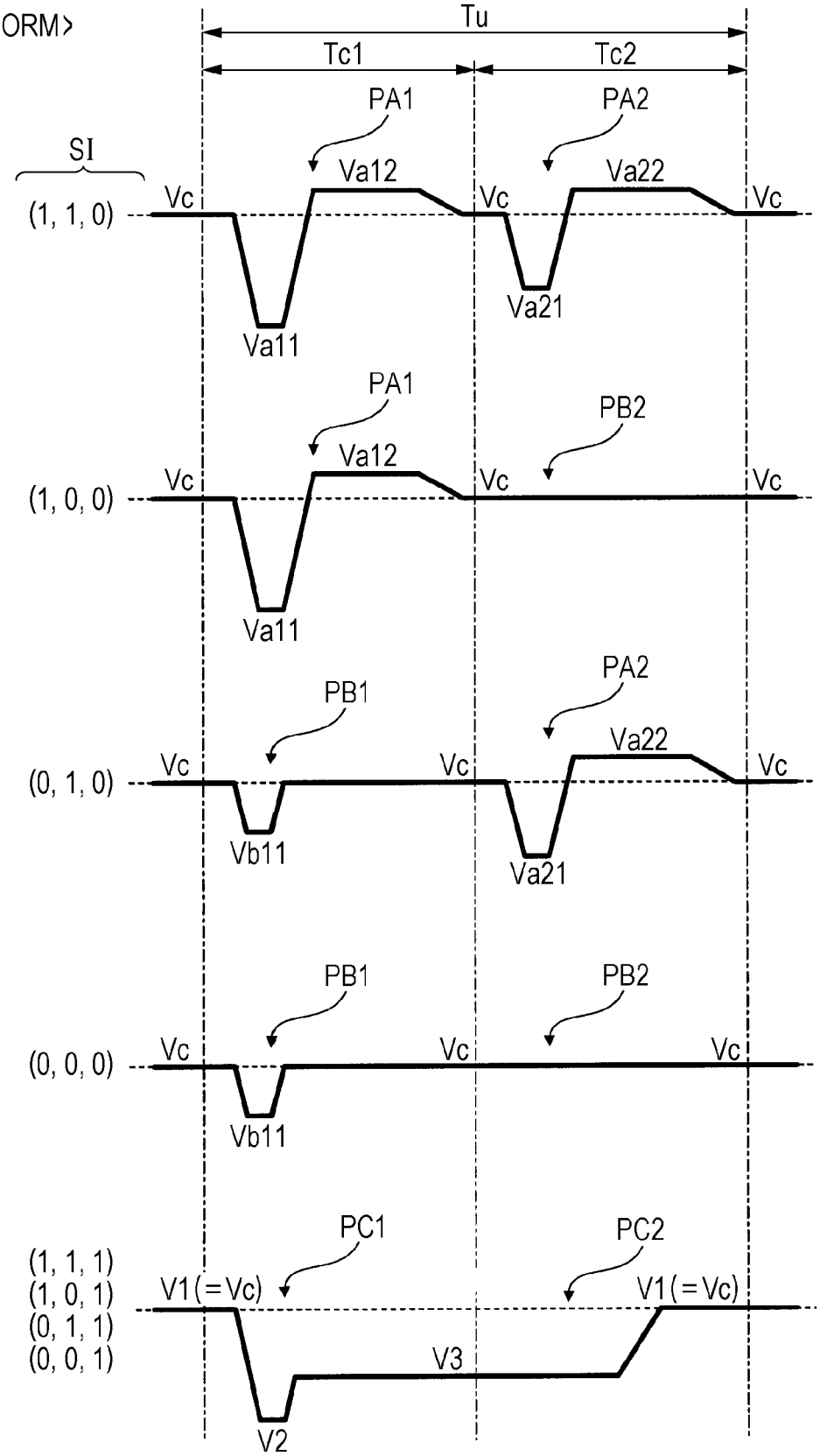
FIG. 13 is a view illustrating a waveform of a driving signal.

The waveform of the driving signal Vin output by the driving signal generation unit 51 in the unit operation period Tu will be described with reference to FIG. 13 in addition to FIGS. 10 to 12.

In a case where the content of the print signal SI [m] supplied in the unit operation period Tu is (b1, b2, b3)=(1, 1, 0), since the selection signals Sa, Sb, and Sc become respectively the H level, the L level, and the L level in the control periods Tc1 and Tc2, the driving waveform signal Com-A is selected by the transmission gate TGa and the unit waveforms PA1 and PA2 are output as the driving signal Vin[m]. In addition, since the selection signals Sa, Sb, and Sc become respectively the H level, the L level, and the L level in the control period Tc2, the driving waveform signal Com-A is selected by the transmission gate TGa and the unit waveform PA2 is output as the driving signal Vin[m].

As a result, the ejection unit 35 in the m-th stage performs ejection of the ink in a moderate amount based on the unit waveform PA1 and ejection of the ink in a small amount based on the unit waveform PA2 in the unit operation period Tu and large dots are formed on paper P for recording because the ink ejected twice is combined with the recorded medium 200.

In a case where the content of the print signal SI [m] supplied in the unit operation period Tu is (b1, b2, b3)=(1, 0, 0), since the selection signals Sa, Sb, and Sc become respectively the H level, the L level, and the L level in the control period Tc1, the driving waveform signal Com-A is selected by the transmission gate TGa and the unit waveform PA1 is output as the driving signal Vin[m]. In addition, since the selection signals Sa, Sb, and Sc become respectively the L level, the H level, and the L level in the control period Tc2, the driving waveform signal Com-B is selected by the transmission gate TGb and the unit waveform PB2 is output as the driving signal Vin[m].

As a result, the ejection unit 35 in the m-th stage performs ejection of the ink in a moderate amount based on the unit waveform PA1 and medium dots are formed on the paper p for recording.

In a case where the content of the print signal SI [m] supplied in the unit operation period Tu is (b1, b2, b3)=(0, 1, 0), since the selection signals Sa, Sb, and Sc become respectively the L level, the H level, and the L level in the control period Tc1, the driving waveform signal Com-B is selected by the transmission gate TGb and the unit waveform PA1 is output as the driving signal Vin[m]. In addition, since the selection signals Sa, Sb, and Sc become respectively the H level, the L lever, and the L level in the control period Tc2, the driving waveform signal Com-A is selected by the transmission gate TGa and the unit waveform PA2 is output as the driving signal Vin[m].

As a result, the ejection unit 35 in the m-th stage performs ejection of the ink in a small amount based on the unit waveform PA2 and small dots are formed on the paper p for recording.

In a case where the content of the print signal SI [m] supplied in the unit operation period Tu is (b1, b2, b3)=(0, 0, 0), since the selection signals Sa, Sb, and Sc become respectively the L level, the H level, and the L level in the control periods Tc1 and Tc2, the driving waveform signal Com-B is selected by the transmission gate TGb and the unit waveforms PB1 and PB2 are output as the driving signal Vin[m].

As a result, the ejection unit 35 in the m-th stage does not perform ejection of the ink in the unit operation period Tu and dots are not formed on the paper P for recording (becomes non-recording).

In a case where the content of the print signal SI [m] supplied in the unit operation period Tu is (b1, b2, b3)=(1 or 0, 1 or 0, 1), since the selection signals Sa, Sb, and Sc become respectively the L level, the L level, and the H level in the control periods Tc1 and Tc2, the driving waveform signal Com-C is selected by the transmission gate TGc and the unit waveforms PC1 and PC2 are output as the driving signal Vin[m].

As a result, the ejection unit 35 in the m-th stage does not perform ejection of the ink in the unit operation period Tu and the ejection state of the ink is inspected.

Figure 14:
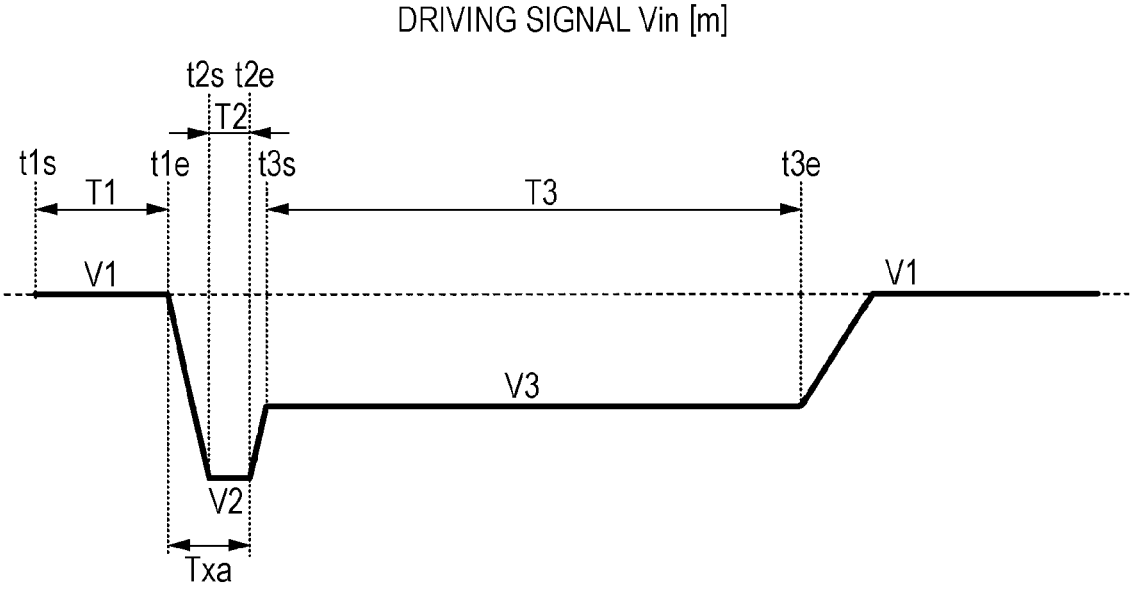
FIG. 14 illustrates a waveform of the driving signal for inspection.

FIG. 14 illustrates a waveform of the driving signal Vin[m] for inspection. The driving signal Vin[m] illustrated in the same figure becomes the first potential V1 in the first period T1 from a time t1s to a time t1e, becomes the second potential V2 in the second period T2 from a time t2s to a time t2e, and becomes the third potential V3 in the third period T3 from a time t3s to a time t3e. Further, the driving signal Vin[m] is moved from the first potential V1 to the second potential V2 (t1e to t2s) and moved from the second potential V2 to the third potential V3 (t2e to t3s).

In this example, an electrical charge charged in the piezoelectric element 500 in the time t1e to the time t2s in which the driving signal Vin[m] is moved from the first potential V1 to the second potential V2 is discharged. As a result, the piezoelectric element 500 is excited so as to draw a meniscus to the inside of the cavity 445. Subsequently, in the second period T2, the second potential V2 is held and the driving signal Vin[m] is moved from the second potential V2 to the third potential V3 in the time t2e to the time t3s. In the period from the time t2e to the time t3s, the electrical charge is charged to the piezoelectric element 500. As a result, the piezoelectric element 500 is displaced in a direction of pushing out the meniscus to the outside of the cavity 445. However, the third potential V3 is set so as for the ink not to be ejected from the nozzle N. If the driving signal Vin[m] is moved from the second potential V2 to the first potential V1, the potential of the piezoelectric element 500 is returned to the original state in a short time, and the ink is ejected.

Here, in the present embodiment, the third potential V3 is set to be the potential between the first potential V1 and the second potential V2. That is, in this example, large pressure change is generated in the inside of the cavity 445 by returning the meniscus so as the ink not to be ejected from the state in which the meniscus is drawn to the inside of the cavity 445. In this manner, it is possible to extract the residual vibration with a large amplitude.

In addition, in the present embodiment, when a time from an end time t1e of the first period T1 to an end time t2e of the second period T2 is set as Txa and a natural vibration period of the cavity 445 is set as Tc, it is preferable to determine the time Txa as follows.

The ink in the cavity 445 is excited by the piezoelectric element 500 being bent. At this time, the pressure in the cavity 445 is synchronized with the natural vibration period Tc and then is increased or decreased. On the other hand, the end time t2e of the second period T2 is the timing of allowing the direction of displacement of the piezoelectric element 500 to be changed. For obtaining the large residual vibration, it is preferable to synchronize with the change in pressure in the cavity 445 and change the direction of displacement of the piezoelectric element 500.

The ink jet printer 1 according to the present embodiment drives the ejection unit 35 by the driving signal Vin for inspection and change in electromotive force of the piezoelectric element 500 based on the change in pressure in the cavity 445 of the ejection unit 35, which is generated as the result of driving the ejection unit 35, is detected as the residual vibration signal Vout. Further, an ejection abnormality detection process which determines whether ejection abnormality is present in the ejection unit 35 based on the residual vibration signal Vout is performed.

FIG. 15 is a block diagram illustrating the configuration of the switching unit 53 in the head driver 50 and a relationship of electrical connection between the switching unit 53 and the ejection abnormality detection unit 52, and the head unit 30 and the driving signal generation unit 51.

As illustrated in the figure, the switching unit 53 includes M switching circuits U (U[1], U[2], . . . , U[M]) in the first to M-th stage in one-to-one correspondence with the M ejection units 35. The switching circuit U[m] in the m-th stage is electrically connects the ejection unit 35 in the m-th stage to one of a wiring to which the driving signal Vin[m] is supplied or the ejection abnormality detection circuit DT included in the ejection abnormality detection unit 52.

Hereinafter, in the respective switching circuits U, a state of electrical connection of the ejection unit 35 and the driving signal generation unit 51 is referred to as a first connection state. In addition, a state of electrical connection of the ejection unit 35 and the ejection abnormality detection circuit DT of the ejection abnormality detection unit 52 is referred to as a second connection state.

The control unit 6 supplies a switching control signal Sw[m] for controlling the connection state of the switching circuit U[m] to the switching circuit U[m] of the m-th stage.

Specifically, the control unit 6 outputs the switching control signals Sw[1], Sw[2], . . . , Sw[M] such that the switching circuit corresponding to the ejection unit 35 that performs printing in the unit operation period Tu is set to the first connection state and the switching circuit corresponding to the ejection unit 35 to be inspected is set to the second connection state. That is, the switching control signals Sw that designate the first connection state and the second connection state may be mixed in the unit operation period Tu, all of the switching control signals Sw may designate the first connection state, and all of the switching control signals Sw may designate the second connection state.

FIG. 16 is a block diagram illustrating the configuration of the ejection abnormality detection circuit included in the ejection abnormality detection unit 52 of the head driver 50.

As illustrated in FIG. 16, the ejection abnormality detection circuit DT includes a detection unit 55 that outputs a detection signal NTc indicating a time length of one cycle of the residual vibration of the ejection unit 35 based on the residual vibration signal Vout and a determination unit 56 that determines the presence of the ejection abnormality in the ejection unit 35 and the ejection state in a case where the ejection abnormality is present and outputs a determination result signal Rs indicating the determination result based on the detection signal NTc.

The detection unit 55 includes a waveform shaping unit 551 that generates a waveform shaping signal Vd in which a noise component or the like is removed from the residual vibration signal Vout to be output from the ejection unit 35 and a measurement unit 552 that generates the detection signal based on the waveform shaping signal Vd or the like.

The waveform shaping unit 551 includes a high-pass filter for outputting a signal allowing a frequency component lower than the frequency band of the residual vibration signal Vout to be damped and a low-pass filter for outputting a signal allowing a frequency component higher than the frequency band of the residual vibration signal Vout to be damped, and has a configuration which can output the waveform shaping signal Vd in which the frequency range of the residual vibration signal Vout is restricted and the noise component is removed.

Further, the waveform shaping unit 551 may have a configuration that includes a negative feedback amplified for adjusting the amplitude of the residual vibration signal Vout and a voltage follower for outputting the waveform shaping signal Vd of a low impedance by converting an impedance of the residual vibration signal Vout.

The waveform shaping signal Vd which is formed by the residual vibration signal Vout being shaped by the waveform shaping unit 551, a mask signal Msk generated by the control unit 6, and a threshold potential Vth_c determined as a potential of an amplitude center level of the waveform shaping signal Vd are supplied to the measurement unit 552. The measurement unit 552 specifies the detection signal NTc, a validity flag Flag indicating whether the detection signal NTc is a valid value, and the amplitude A of the detection signal NTC to be output based on these signals.

Figure 17:
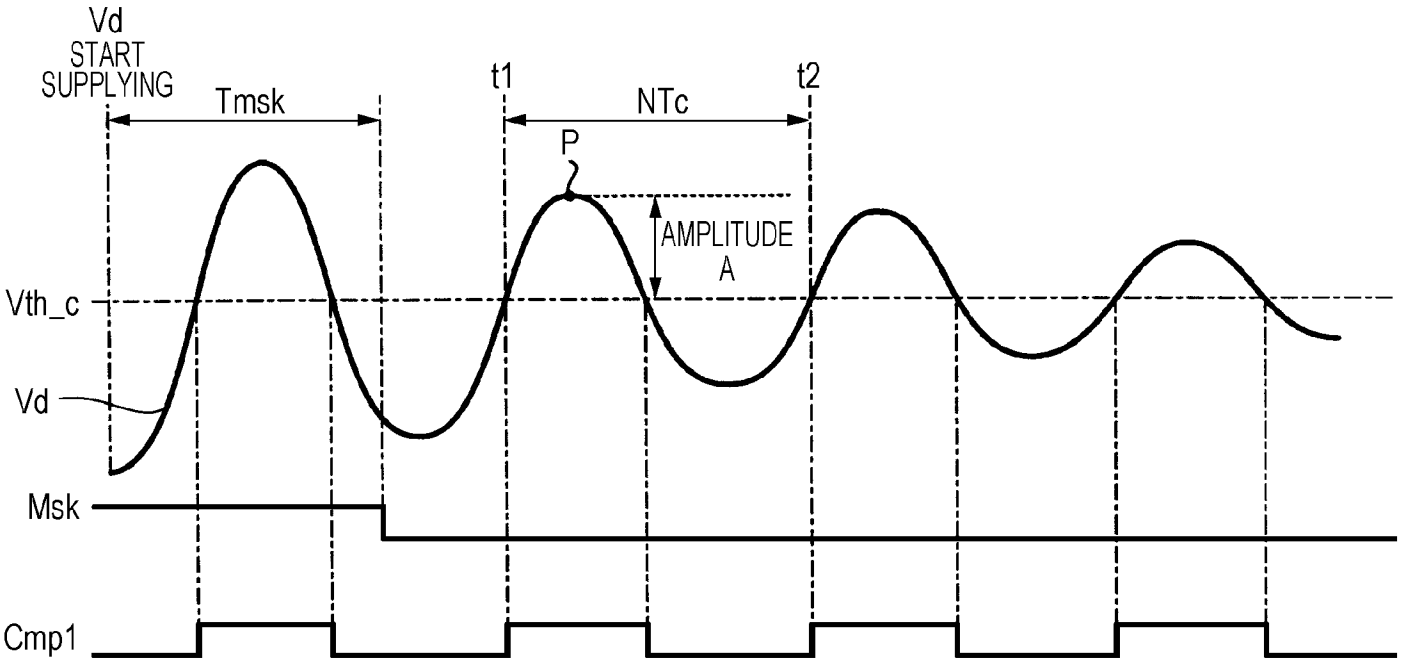
FIG. 17 is a view illustrating a timing chart according to an operation of a measurement unit.

FIG. 17 is a timing chart illustrating the operation of the measurement unit 552. As illustrated in the figure, the amplitude A is a value of a difference between a peak value P that appears in the detection signal NTc and the threshold potential Vth-C for the first time. The peak value P that appears in the detection signal NTc for the first time becomes one of an upper peak value and a lower peak value by the period Tmask being finished at any time of the waveform shaping signal Vd. The example illustrated in the figure is an example in which the peak value P is the upper peak value.

As illustrated in FIG. 17, the measurement unit 552 generates a comparison signal Cmp1 in which the potential indicated by the waveform shaping signal Vd becomes a high level in a case where the potential is more than or equal to the threshold potential Vth_c and the potential indicated by the waveform shaping signal Vd becomes a low level in a case where the potential is less than the threshold potential Vth_c when the potential indicated by the waveform shaping signal Vd is compared to the threshold potential Vth_c.

The mask signal Msk is a signal which becomes the high level only for a predetermined period Tmask from when the waveform shaping signal Vd is started to be supplied from the waveform shaping unit 551. In the present embodiment, the detection signal with high precision from which the noise component superimposed immediately after the residual vibration is started is removed can be obtained by generating the detection signal NTc only with the waveform shaping signal Vd after the lapse of the period Tmsk as a target.

The measurement unit 552 includes a counter (not illustrated). The counter starts counting clock signals (not illustrated) in a time t1 which is the timing in which the potential indicated by the waveform shaping signal Vd becomes equivalent to the threshold potential Vth_c for the first time after the mask signal Msk is fallen in the low level. That is, the counter starts counting at the time t1 which is the earlier timing between the timing in which the comparison signal Cmp1 is risen in the high level for the first time or the timing in which the comparison signal Cmp1 is fallen in the low level for the first time after the mask signal Msk is fallen in the low level.

In addition, the counter finishes counting of the clock signals in a time t2 which is the timing in which the potential indicated by the waveform shaping signal Vd becomes the threshold potential Vth_c for the second time after the counting is started and outputs the obtained counted value as the detection signal NTc. That is, the counter finishes counting in the time t2 which is the earlier timing between the timing in which the comparison signal Cmp1 is risen in the high level for the second time or the timing in which the comparison signal Cmp1 is fallen in the low level for the second time after the mask signal Msk is fallen in the low level.

In this manner, the measurement unit 552 measures the time length from the time t1 to the time t2 as the time length of one period of the waveform shaping signal Vd and generates the detection signal NTc as a signal indicating the residual vibration waveform from the time t1 to the time t2. That is, the time length of the detection signal Ntc indicates the period of the waveform shaping signal Vd (that is, the period of the residual vibration signal Vout).

However, in a case where the amplitude of the waveform shaping signal Vd is small, it is highly possible that the measurement unit 552 may not perform accurate measurement on the detection signal NTc. In addition, in the case where the amplitude of the waveform shaping signal Vd is small, when it is determined that the ejection state of the ejection unit 35 is normal only based on the result of the detection signal Ntc, there is a possibility that the ejection abnormality is actually generated. For example, in the case where the amplitude of the waveform shaping signal Vd is small, it is considered that the ink may not be ejected because the ink has not been injected to the cavity 445.

Here, in the present embodiment, it is determined whether the amplitude of the waveform shaping signal Vd has the size sufficient for the measurement of the detection signal NTc and the determination result is output as the validity flag Flag.

Specifically, the measurement unit 552 sets the value of the validity flag Flag as a value "1" indicating that the detection signal NTc is valid in a case where the amplitude A is more than or equal to the "predetermined value" in the period for which the counter performs counting, that is, from the time t1 to time t2, and outputs the validity flag Flag by setting the value of the validity flag Flag as "0" in other cases. Here, the "predetermined value" is the minimum value in which the value of the amplitude A has reliability. When the amplitude A is a value less than or equal to the predetermined value, the value is not reliable, so the value of the validity flag Flag is set as "0" and is not used for measurement of the detection signal NTc.

In this manner, in the present embodiment, since the measurement unit 552 generates the detection signal NTc indicating the time length of one cycle of the waveform shaping signal Vd and determines whether the waveform shaping signal Vd has the amplitude with the size sufficient for the measurement of the detection signal NTc, the measurement unit 552 can detect the ejection abnormality more accurately.

The determination unit 56 determines the ejection state of the ink in the ejection unit 35 based on the detection signal NTc, the amplitude A, and the validity flag Flag, and outputs the determination result as a determination result signal Rs.

Figure 18:
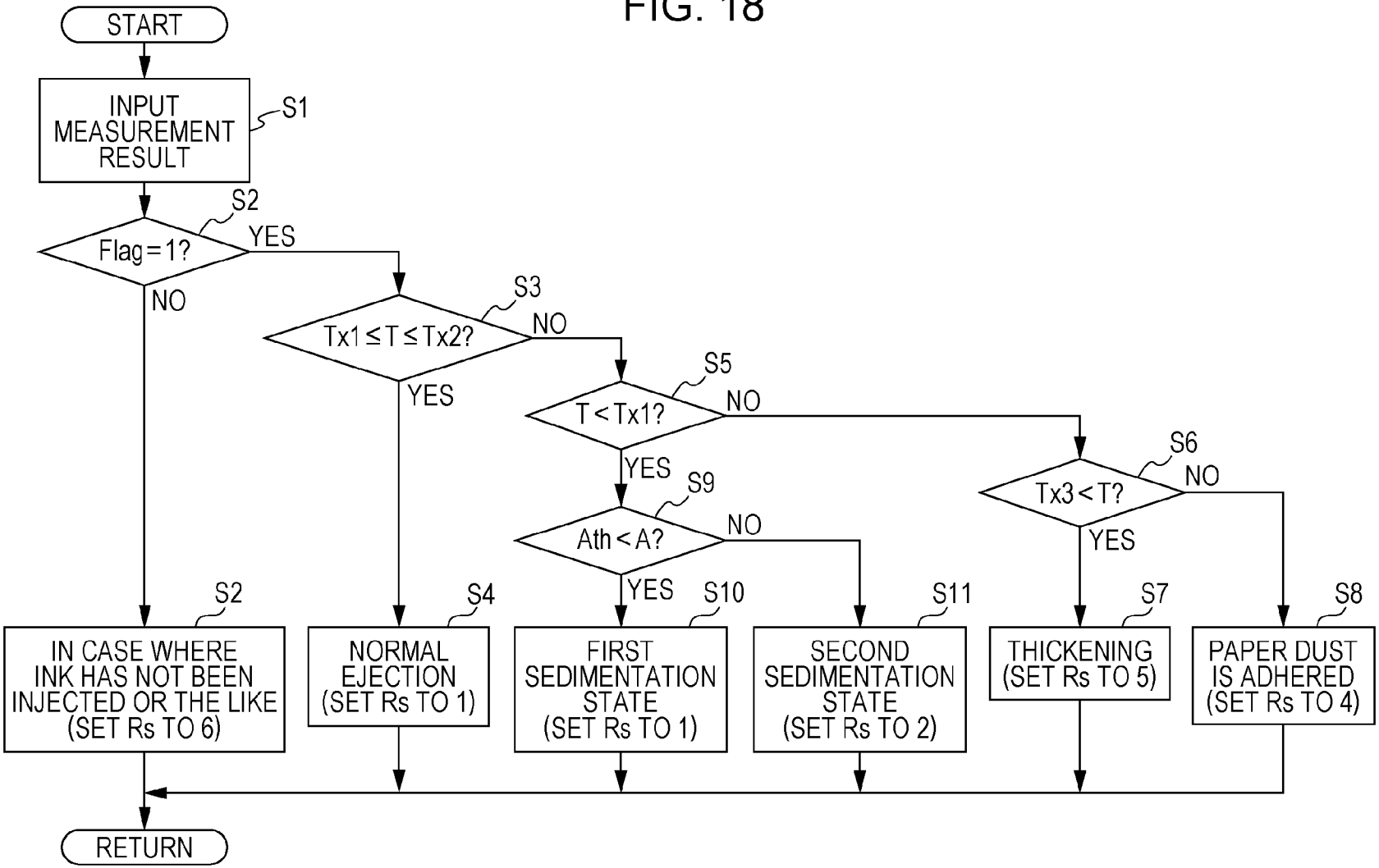
FIG. 18 is a diagram illustrating a flowchart of a process of determining a cause related to ejection abnormality.

FIG. 18 is a flowchart illustrating a process of determining the causes on the ejection abnormality, which is performed by the determination unit 56 of the ink jet printer 1 according to the present embodiment. FIG. 19 is a view illustrating the specific contents of the determining process performed by the determination unit 56. As illustrated in FIG. 19, the determination unit 56 respectively compares a time length (hereinafter, referred to as "the period (of the residual vibration)") T indicated by the detection signal NTc with a threshold value Tx1, a threshold value Tx2 representing a period longer than the threshold value Tx1, and a threshold value Tx3 representing a period longer than the threshold value Tx2. Further, the amplitude A of the detection signal NTc is compared with a threshold value Ath.

First, when the measurement result by the measurement unit 552 is input to the determination unit 56 (Step S1), the determination unit 56 determines whether a set value of the validity flag Flag is "1" (Step S2). In a case where the determination result in Step S2 is negative (in a case where the set value of the validity flag Flag is "0"), the determination unit 56 sets "6" as the determination result signal Rs (Step S2). The set value "6" of the determination result signal Rs is a set value indicating that the ejection abnormality is generated for some cause, for example, the ink has not been injected into the cavity 445 as illustrated in FIG. 19.

In contrast, in a case where the determination result of Step S2 is positive, the determination unit 56 determines whether the period T of the residual vibration satisfies Expression 5 below (Step S3).

$$Tx1 \leq T \leq Tx2 \quad \text{(Expression 5)}$$

The threshold value Tx1 is a boundary value between the cycle of the residual vibration in a case where sedimentation of the pigment component of the ink occurs in the cavity 445 or the like and the cycle of the residual vibration in a case where the ejection state is normal. The threshold value Tx2 is a boundary value between the cycle of the residual vibration in a case where paper dust is adhered in the vicinity of the outlet of the nozzle N and the cycle of the residual vibration in a case where the ejection state is normal.

In a case where the determination result in Step S3, the determination unit 56 sets "1" illustrated in FIG. 19 as the determination result signal Rs (Step S4). The set value "1" of the determination result signal Rs is a set value indicating that the ejection state of the ink in the ejection unit 35 is normal.

In contrast, in a case where the determination result in Step S3, the determination unit 56 determines whether the cycle T of the residual vibration satisfies Expression 6 below (Step S5).

$$T < Tx1 \quad \text{(Expression 6)}$$

In a case where the determination result in Step S5 is negative, the determination unit 56 determines whether the cycle T of the residual vibration satisfies Expression 7 below (Step S6).

$$Tx3 < T \quad \text{(Expression 7)}$$

The threshold value Tx3 is a boundary value between the cycle of the residual vibration in a case where the ink is thickened in the vicinity of the nozzle N and the cycle of the residual vibration in a case where paper dust is adhered to the vicinity of the outlet of the nozzle N.

In a case where the determination result in Step S6 is positive, the determination unit 56 sets "5" as the determination result signal Rs (Step S7). The set value "5" of the determination result signal Rs is a set value indicating that the ejection abnormality occurs by the ink being thickened in the vicinity of the nozzle N as illustrated in FIG. 19.

On the other hand, in a case where the determination result in Step S6 is negative, the determination unit 56 sets "4" as the determination result signal Rs (Step S8). The set value "4" of the determination result signal Rs is a set value indicating that the ejection abnormality occurs by paper dust adhered to the vicinity of the nozzle N as illustrated in FIG. 19.

On the other hand, the case where the determination result in Step S5 is positive is a case in which the sedimentation state is generated in the cavity 445. In this case, the determination unit 56 determines whether the amplitude A of the residual vibration satisfies Expression 8 below (Step S9).

$$Ath<A \quad \text{(Expression 8)}$$

The threshold value Ath is a boundary value between the amplitude of the residual vibration when the first sedimentation state occurs in the cavity 445 and the amplitude of the residual vibration when the second sedimentation state occurs.

In a case where the determination result in Step S9 is positive, the determination unit 56 sets "1" as the determination result signal Rs (Step S10). The set value "1" of the determination result signal Rs is a set value indicating that the first sedimentation state occurs in the cavity 445 as illustrated in FIG. 19.

In contrast, when the determination result in Step S9 is negative, the determination unit 56 sets "2" as the determination result signal Rs (Step S11). The set value "2" of the determination result signal Rs is a set value indicating that the second sedimentation state occurs in the cavity 445 as illustrated in FIG. 19.

When the values of the determination result signals Rs indicating the causes of the ejection abnormality in Step S2, S4, S7, S8, S10, or S11, the determination result signal Rs is output to the control unit 6 and terminates the determination process.

On the other hand, the control unit 6 stops the printing process (strictly, allows the print operation period to be stopped) as needed in a case where the determination result signal Rs indicating that the ejection abnormality occurs is input, and allows the head unit 30 to move to the initial position (X=Xini), and then performs an appropriate recovery process according to the causes of the ejection abnormality indicated by the determination result signal Rs using a recovery unit 70.

The recovery unit 70 is a unit for recovering the normal ejection function of the ejection unit 35 by performing the recovery process according to the causes (according to the determination result signal Rs) when the ejection abnormality occurs. Specifically, examples of the recovery process performed by the recovery unit 70 include the above-described pumping process, the above-described wiping process, the "flushing process," and a "stirring vibration process." Respective members performing these respective recovery processes function as the respective recovery units 70. Accordingly, in the pumping process, the above-described suction pump 130 functions as the recovery unit 70. In addition, in the wiping process, the above-described wiping member 140 or the like functions as the recovery unit 70.

The "flushing process" is a head cleaning process of allowing the nozzle N to eject ink droplets by making a state in which the ink droplets are not splashed on the recorded medium 200 by covering the outlet of the object nozzle N with the capping unit 120. In the flushing process, the head driver 50, the head unit 30, and the like function as the recovery unit 70.

The "stirring vibration process" is a process of diffusing the pigment component of the ink settled in the cavity 445 by allowing the cavity 445 to expand or be contracted without allowing the ink to be ejected from the nozzle N. Specifically, the control unit 6 allows the driving signal (stirring driving signal) that makes the piezoelectric element 500 to minutely vibrate to be generated in the driving signal generation unit 51 such that the ink is not ejected from the nozzle N and the ink in the cavity 445 is not stirred. In the stirring vibration process, the head driver 50, the head unit 30, and the like function as the recovery unit 70.

In the ink jet printer in the related art, a recovery unit that performs the recovery process when the ejection abnormality occurs is present. However, for example, since the flushing process is a process of discarding a certain amount of ink, it is preferable to avoid the flushing process as much as possible from the viewpoint of suppressing the amount of ink consumption. For example, the flushing process is necessary to be performed in a case where the flushing process is actually needed such as the case where the ink is thickened or the second sedimentation state is generated, but it is sufficient to perform the stirring vibration process in a case where the first sedimentation state is generated.

However, in the ink jet printer in the related art, since it is impossible to clearly determine that the sedimentation of the pigment component of the ink occurs, the flushing process is performed in some cases even in a case where the flushing process is not actually required (for example, in a case where the ink is thickened or the second sedimentation state is generated).

In light of the above description, the case where the ink is thickened, the case where the first sedimentation state is generated, and the case where the second sedimentation state is generated are detected by distinguishing the cases from one another by the process described with reference to FIGS. 18 and 19 in the present embodiment, and the control unit 6 performs the flushing process using the recovery unit 70 only the cases where the ink is thickened and the second sedimentation state is generated based on the detection result. Accordingly, since the number of executions of the flushing process is suppressed to be minimum, unnecessary consumption of the ink is suppressed.

As described above, according to the embodiment of the invention, it is possible to provide a liquid ejection apparatus 1 capable of determining that sedimentation of the pigment component of the ink occurs.

In addition, the determination by the determination unit 56 described with reference to FIGS. 18 and 19 may be performed by the control unit 6 (CPU 61). In this case, the ejection abnormality detection circuit DT of the ejection abnormality detection unit 52 is configured without the determination unit 56 and is not limited as long as the ejection abnormality detection circuit DT outputs the detection signal NTc generated by the detection unit 55 to the control unit 6.

B. Modified Example

The embodiment described above can be variously modified. Specific Modified Examples are as follows.

First Modified Example

The description overlapping with the above-described embodiment will be omitted and only differences will be described. The differences are the determination process performed by the determination unit 56 of the ink jet printer 1. That is, the process of the flowchart described with reference to FIG. 18 is merely an example and the processes in all steps are not necessarily performed and the process order of each step is not necessary to follow. Hereinafter, details will be described.

When the process of determining the causes on the ejection abnormality is performed, the determination unit 56 can perform the determination processes in steps which are executable in an arbitrary timinig after information (the validity flag Flag, the detection signal NTc (that is, the cycle T of the residual vibration), or the amplitude A) that makes the determination processes in each step possible is input.

Specifically, the determination unit 56 may perform the determination processes subsequent to the determination process in Step S3 (process of determining whether the ejection abnormality occurs) without performing the determination process (Step S2) of the set value of the validity flag Flag. Further, the determination unit 56 may perform the determination processes subsequent to Step S5 (process of determining the cause of the ejection abnormality) without performing the determination process related to Step S3. That is, the determination unit 56 may perform the determination processes related to desired steps in desired process order without following the processing orders of the flowchart shown in FIG. 18. In addition, when the determination process related to a specific step is unnecessary, the determination process related to the step may not be performed by the determination unit 56.

Second Modified Example

The driving signal Vin for inspection in the above-described embodiment adopts the first potential V1, the second potential V2, and the third potential V3, but the invention is not limited thereto, and the driving signal Vin may be a signal waveform including four or more kinds of potential.

For example, as illustrated in FIG. 20, a fourth period T4 that maintains a fourth potential V4 is provided in a period between the end time t1e of the first period T1 and the start time t2s of the second period T2, the driving signal may be moved from the first potential V1 to the fourth potential V4 from the time t1e to the time t4s, and the driving signal may be moved from the fourth potential V4 to the second potential V2 from the time t4e to the time t2s.

Here, a potential difference ΔV42 between the fourth potential V4 and the second potential V2 is larger than a potential difference ΔV12 between the first potential V1 and the second potential V2. Accordingly, the driving signal Vin for inspection of the present modified example can allow the ink in the cavity 445 to be excited with a large force when compared to that of the present embodiment. Therefore, it is effective when the viscosity of the ink is high.

In addition, when the time from an end time t4e of the fourth period T4 to an end time t2e of the second time T2 is set as Txb and the natural vibration period of the cavity 445 is set as Tc, the time Txb is preferably Tc/2 and may satisfy (Expression 9) described below.

$$Tc/2-Tc/4<Txb<Tc/2+Tc/4 \quad \text{(Expression 9)}$$

Further, particularly, since the range of Tc/2 to Tc/2+Tc/4 becomes after the pressure is turned to increase from decrease, the efficiency can be improved by setting the time Txb in that range.

Third Modified Example

In the above-described embodiment and the modified example, the ink jet printer is a line printer as illustrated in FIG. 1, but may be a serial printer. For example, an ink jet printer which includes a head unit having a width in a Y-axis direction smaller than the width of the paper P for recording instead of the head unit 30 as illustrated in FIG. 1 and in which the main scanning direction of the carriage becomes the Y-axis direction may be provided.

Fourth Modified Example

In the above-described embodiment and modified examples, an ink jet printer is exemplified as an example of a liquid ejection apparatus that ejects an ink as a liquid, but the invention is not limited thereto, and any liquid ejection apparatus can be used as long as the device ejects a liquid. For example, a device that ejects a liquid (containing a dispersion liquid such as a suspension and an emulsion) containing various materials as describe below. In other words, examples of the various materials include a filter material (ink) of a color filter, a light emitting material for forming an EL light emitting layer in the organic EL (Electro Luminescence) device, a fluorescent material for forming a fluorescent substance on an electrode of an electron emission device, a fluorescent material for forming a fluorescent substance in a Plasma Display Panel (PDP), an electrophoretic material that forms an electrophoretic body in an electrophoretic display device, a bank material for forming a bank on a surface of a substrate W, various coating materials, a liquid electrode material for forming an electrode, a particulate material that constitutes a spacer for constituting a minute cell gap between two sheets of substrates, a liquid metal material for forming a metal wiring, a lens material for forming a microlens, a resist material, a light diffusion material for forming a light diffusion body, and various test liquid materials which are used for a biosensor such as a DNA chip or a protein chip.

Further, in the invention, a light receiving material as an object for ejecting a liquid is not particularly limited, and works, for example, various substrates such as other media like a film, a woven fabric, and a nonwoven fabric, a glass substrate, and a silicon substrate may be used.

C. Application Example

First Application Example

According to the liquid ejection apparatus 1 of the above-described embodiment, since the sedimentation of the pigment component of the ink can be detected by distinguishing from other phenomena and the degree of the sedimentation can be detected, it is possible to perform the appropriate recovery process according to the degree of the sedimentation and to suppress unnecessary consumption of the ink due to the flushing process.

Since the white ink according to the present application example has high redispersibility, it is sufficient to perform the stirring vibration process even when sedimentation occurs to a degree that the flushing process is necessary to be performed as a recovery process in a case of using the ink in the related art by using the liquid ejection apparatus 1 according to the above-described embodiment and the white ink according to the present application example. That is, since the number of execution of the flushing process can be more suppressed, the unnecessary consumption of the ink can be suppressed.

Hereinafter, details of the white ink according to the present application example will be described.

A white ink jet ink for textile printing according to the present application example is an ink jet ink for textile printing which includes a white pigment and a urethane resin, and in which the average particle size of the white pigment and the average particle size of the urethane resin satisfy (Expression 10) below.

$$2 \leq \text{average particle size of white pigment/average particle size of urethane resin} \leq 12 \quad \text{(Expression 10)}$$

Hereinafter, respective components included in the ink jet ink according to the present embodiment will be described in detail.

White Pigment

The ink jet ink according to the present application example includes a white pigment. As the white pigment, for example, a metal oxide, barium sulfate, and calcium carbonate can be exemplified. Examples of the metal oxide include titanium dioxide, zinc oxide, silica, alumina, and magnesium oxide. Among these, titanium dioxide is preferable from a viewpoint of excellent whiteness.

The average particle size of the white pigment is not particularly limited as long as the expression is satisfied, but the average particle size thereof is preferably in the range of 300 nm to 400 nm. When the average particle size thereof exceeds 400 nm, it may lead to degradation of reliability like deterioration of an ejection property of the white ink. In contrast, the average particle size is less than 300 nm, there is a tendency that the color density such as the whiteness becomes insufficient. In the present specification, the average particle size means the cumulative 50% particle size on a volume basis and is measured by a light scattering method. The average particle size can be performed using a MICROTRAC UPA 150 (manufactured by Microtrac Inc.).

The content of the white pigment is preferably in the range of 5% by mass to 15% by mass based on the total mass of the ink jet ink. When the content of the white pigment exceeds 15% by mass, clogging of an ink jet recording head may occur so that the reliability is degraded in some cases. In contrast, the content thereof is less than 5% by mass, the color density such as whiteness becomes insufficient in some cases.

Urethane Resin

The ink jet ink according to the present application example contains a urethane resin. The urethane resin is not particularly limited to be used. Examples of the urethane resin, which are not particularly limited, include a polyether urethane resin containing an ether bond in the main chain, a polyester urethane resin containing an ester bond in the main chain, and a polycarbonate urethane resin containing a carbonate bond in the main chain in addition to the urethane bond. Among these, a polycarbonate urethane resin and a polyester urethane resin can be preferably used.

The average particle size of the urethane resin, which is not particularly limited, is preferably in the range of 25 nm to 180 nm. By setting the average particle size to be in the range, advantageous effects that the aggregation and solidification are suppressed while the white ink is settled and the redispersibility is suppressed can be obtained. On the other hand, when the average particle size is more than 180 nm, the ejection property of the white ink is deteriorated so that the reliability is degraded. Further, when the average particle size is less than 25 nm, there is a concern that a fixing property of a printed textile is degraded and rubbing fastness is deteriorated. In addition, as a mode of the urethane resin in the ink, which is not particularly limited, an emulsion is preferably used.

The acid value of the urethane resin, which is not particularly limited, is preferably in the range of 10 mgKOH/g to 25 mgKOH/g. By setting the acid value to be in the range, advantageous effects that permeation of the white ink is suppressed and a high color density can be realized can be obtained. When the acid value exceeds 25 mgKOH/g, there is a concern that the solubility of the urethane resin is increased and the rubbing fastness is deteriorated. In addition, the acid value is less than 10 mgKOH/g, there is a tendency that the reactivity between the urethane resin and a polyvalent metal ion which is present in a pretreatment agent for textile printing is low and the white ink is permeated. Here, the acid value in the present specification is measured by a titration method.

Examples of the urethane resin include a commercially available products, for example, SF150 (average particle size 70 nm), SF150HS (average particle size 110 nm), SF210 (average particle size 50 nm), SF800 (average particle size 30 nm), SF870 (average particle size 30 nm), SF460 (average particle size 30 nm), and SF470 (average particle size 50 nm) in Superflex (SF) series (manufactured by Dai-ichi Kogyo Seiyaku Co., Ltd.); WS-5000 (average particle size 90 nm), WS6021 (average particle size 70 nm), W6010 (average particle size 60 nm), W6020 (average particle size nm), W6061 (average particle size 100 nm), and W605 (average particle size 80 nm) in Takelac series (manufactured by Mitsui Chemicals Co., Ltd.). Among these urethane resins, SF150, SF470, and the like (manufactured by Dai-ichi Kogyo Seiyaku Co., Ltd.) in which the acid value of the resin satisfies the range of 10 mgKOH/g to 25 mgKOH/g synthesized by a known method can be used as the urethane resin.

Other Components

At least one kind selected from alkanediol and glycol ether may be added to the white ink jet ink for textile printing according to the present application example in addition to components. The alkanediol and the glycol ether can improve permeability of the ink by improving a wettability to a recorded surface of a recording medium or the like.

The white ink jet ink for textile printing according to the present application example can contain a dispersant. The content of the dispersant is preferably in the range of 3% by mass to 30% by mass based on the content of the white pigment. By setting the content of the dispersant and the white pigment to be in the range, the ink with excellent dispersibility of the white pigment can be obtained and the ink with excellent redispersibility can be obtained even when the white pigment is aggregated.

An acetylene glycol-based surfactant or a polysiloxane-based surfactant may be added to the ink jet ink according to the present application example in addition to components. The acetylene glycol-based surfactant or the polysiloxane-based surfactant can improve permeability of the ink by improving the wettability to a recorded surface of a recording medium or the like.

Further, other surfactants such as an anionic surfactant, a nonionic surfactant, and amphoteric surfactant may be added to the ink jet ink according to the present application example. The content of the surfactant is preferably in the range of 0.01% by mass to 5% by mass and more preferably in the range of 0.1% by mass to 0.5% by mass based on the total mass of the ink jet ink.

Polyhydric alcohol may be added to the ink jet ink according to the present application example in addition to components. The polyhydric alcohol can prevent drying of the ink and clogging of the ink in the ink jet recording head portion. The content of the polyhydric alcohol is preferably in the range of 0.1% by mass to 30% by mass and more preferably in the range of 0.5% by mass to 20% by mass based on the total mass of the ink jet ink.

The ink jet ink according to the present application example may be an aqueous ink containing more than or equal to 50% by mass of water. The aqueous ink has weak reactivity to a piezoelectric element or the like to be used for a recording head or an organic binder or the like contained in a recording medium compared to a non-aqueous (solvent-based) ink, so the aqueous ink has less failure of being melt or eroded. In addition, in a non-aqueous (solvent-based) ink, when a solvent to be used has a high melting point and low viscosity, a problem in that drying time takes too long is generated. Further, the smell of the aqueous ink is extremely suppressed compared to the solvent-based ink, so there is an advantage that the aqueous ink is good for the environment because more than half thereof is water. Further, examples of water include ion exchange water, reverse osmosis water, distilled water, and ultrapure water, and the content of water is preferably in the range of 50% by mass to 90% by mass.

The ink jet ink according to the present application example can be prepared similarly to the pigment ink in the related art using a known device in the related art such as a ball mill, a sand mill, an attritor, a basket mill, or a roll mill. At the time of preparation, it is preferable to remove coarse particles using a membrane filter or a mesh filter.

Second Application Example

According to the liquid ejection apparatus 1 of the above-described embodiment, since the sedimentation of the pigment component of the ink can be detected by distinguishing from other phenomena and the degree of the sedimentation can be detected, it is possible to perform the appropriate recovery process according to the degree of the sedimentation and to suppress unnecessary consumption of the ink due to the flushing process.

The white ink according to the present application example has excellent ejection stability and can record an image with high whiteness. Particularly, even when a sediment containing the white pigment is generated, the sediment is hardly cured or thickened, so the ejection failure is hardly generated even when the white ink is stored for a long period of time in a state in which the white ink is supplied to the ink jet recording device. Accordingly, it is sufficient to perform the stirring vibration process even when sedimentation occurs to a degree that the flushing process is necessary to be performed as a recovery process in a case of using the ink in the related art by using the liquid ejection apparatus 1 according to the above-described embodiment and the white ink according to the present application example together. That is, since the number of execution of the flushing process can be more suppressed, the unnecessary consumption of the ink can be suppressed.

Hereinafter, details of the white ink according to the present application example will be described.

The white ink for ink jet recording (hereinafter, also simply referred to as "white ink") according to the present application example has an average particle size of 200 nm to 400 nm, contains a white pigment made of a metal oxide, and satisfied Expression 11 below.

$$0.5\times A \leq V \leq 1.3\times A \quad \text{(Expression 11)}$$

In Expression 11, A represents a content (% by mass) of the white pigment contained in the white ink. In addition, V represents a ratio (%) of the volume of the white pigment based on the total volume of the white ink when the white pigment is completely settled in the white ink.

Here, "the white pigment is completely settled in the white ink" means that the white ink is filled in the ink jet printer and is stored under a condition of a temperature of 20° C. and a humidity of 50% RH for approximately 6 months.

In addition, "V" in Expression 11 is also referred to as a sedimentation volume ratio (%) in the present specification and can be obtained by calculating the volume of a lower layer using an interface of the ink divided into two layers as a reference when the white pigment is completely settled in the white ink. Specifically, when the white pigment is completely settled in the white ink, the ink is divided into an upper layer formed of a transparent liquid (mainly formed of a solvent) and a lower layer formed of a white sediment (mainly formed of a white pigment). At this time, a ratio of the volume of the lower layer to the total volume of the upper layer and the lower layer is calculated. In this manner, the sedimentation volume ratio (%) can be acquired.

When a sediment containing the white pigment in the ink jet recording device is generated, it is found that the sediment is hardly cured or thickened by the sedimentation volume ratio satisfying Expression 11. The white ink having excellent ejection stability can be obtained by satisfying Expression 10.

Specifically, in Expression 11, when V is less than 0.5×A, the sediment is in a state of being rigid and in close contact with a channel with high density, which is not preferable. On the other hand, in Expression 10, when V is exceeds 1.3×A, the sediment is present in the channel with high viscosity, which is not preferable as the white ink. In addition, in Expression 11, when the white ink satisfies a relationship of $0.6\times A \leq V \leq 1.0\times A$, the white ink becomes further excellent white ink.

White Ink

The white ink according to the present application example contains a white pigment made of a metal oxide. As the metal oxide, for example, titanium dioxide, zinc oxide, silica, alumina, or magnesium oxide can be exemplified. Among these, titanium dioxide is preferable from a viewpoint of excellent whiteness and abrasion resistance.

Further, particles having a hollow structure disclosed in the specification of U.S. Pat. No. 4,880,465 are not contained in the white pigment. The reason for this, Expression 11 is not satisfied because the particles having a hollow structure are bulk.

The average particle size of the white pigment on the volume basis (hereinafter, referred to as "average particle size") is in the range of 200 nm to 400 nm. By setting the average particle size of the white pigment to be in the range or not to be below the lower limit, an image having excellent whiteness can be recorded. In addition, by setting the average particle size of the white pigment to be in the range or not to exceed the upper limit, the white ink having excellent ejection stability can be obtained.

The average particle size of the white pigment can be measured by a particle size distribution measuring device with a laser diffraction scattering method as a measurement principle. As the particle size distribution measuring device, for example, a particle size distribution meter (for example, "MICROTRAC UPA" manufactured by Nikkiso Co., Ltd.) with a dynamic light scattering method as a measurement principle can be exemplified.

The content (solid content) of the white pigment is preferably in the range of 1% to 30% based on the total content of the white ink and more preferably in the range of 1% to 20%. By setting the content of the white pigment to be in the range or not to be below the lower limit, the color density of the whiteness or the like becomes excellent in some cases. Further, by setting the content of the white pigment to be in the range or not to exceed the upper limit, it is possible to reduce generation of nozzle clogging.

Resin

The white ink according to the present application example can contain a resin. Examples of the functions of a resin include fixation of the white ink to a recording medium and dispersion of the white pigment in the white ink.

Examples of the resin include known resins such as an acrylic resin, a styrene-acrylic resin, a fluorene resin, a urethane resin, a polyolefin resin, a rosin-modified resin, a terpene resin, a polyester resin, a polyamide resin, an epoxy resin, an ethylene-vinyl acetate copolymer resin; and a polyolefin wax. These resins can be used alone or in combination of two or more kinds thereof.

In resins, a styrene acrylic resin can be preferably used since an action of thickening a sediment is small.

Examples of the styrene acrylic resin include a styrene acrylic acid copolymer, a styrene-methacrylic acid copolymer, a styrene-methacrylic acid-acrylic acid ester copolymer, a styrene-α-methylstyrene-acrylic acid copolymer, and a styrene-α-methylstyrene-acrylic acid-acrylic acid ester copolymer. In addition, as a mode of the copolymer, any one of a random copolymer, a block copolymer, an alternating copolymer, and a graft copolymer can be used. In addition, as the styrene acrylic resin, a commercially available product may be used. Examples of the commercially available product of the styrene acrylic resin include YS-1274 (a solution type, manufactured by Seiko PMC Corporation) and JONCRYL 61J (a solution type, manufactured by BASF Japan Ltd.).

In a case of containing a resin, the content is preferably in the range of 0.5% by mass to 9% by mass based on the total mass of the white ink. By setting the content of the resin to be in the range, the sediment containing the white pigment is hardly cured or thickened.

Further, it is preferable that the white ink according to the present application example be substantially free of a vinyl chloride resin because the vinyl chloride resin allows the sediment containing the white pigment to be thickened in some cases.

"Substantially free of the vinyl chloride resin" means that the content of the vinyl chloride resin in the ink is preferably 0.1% by mass or less, more preferably 0.05% by mass or less, and still more preferably 0.01% by mass or less.

Silica Particles

The white ink according to the present application example can contain silica ($SiO_2$) particles. The silica particles have a function of suppressing curing of the sediment containing the white pigment. Specifically, the silica particles enter between particles of the white pigment and function as a spacer so that curing of the sediment can be suppressed.

It is preferable that a colloidal solution allowing silica particles to be dispersed in water or an organic solvent (colloidal silica) be added to the silica particles. In this manner, the silica particles can be easily dispersed in the ink. As the colloidal silica, commercially available products, for example, Quattron PL-1, PL-3, and PL-7 (manufactured by Fuso Chemical Co., Ltd.); Snowtex XS, OXS, NXS, and CXS-9 (manufactured by Nissan Chemical Co., Ltd.) can be exemplified.

When the silica particles are contained, the content is preferably in the range of 0.1% by mass to 5% by mass and more preferably in the range of 0.5% by mass to 3% by mass based on the total mass of the white ink. When the content of the silica particles is in the range, an action of suppressing curing of the sediment is further enhanced in some cases.

The preferable average particle size of the silica particles on the volume basis is in the range of 30 nm to 120 nm. By setting the content to be in the range, the function as a spacer of the white pigment is excellently exerted. In addition, a preferable relationship of the average particle size between the white pigment and the silica particles is preferably (average particle size of white pigment:average particle size of silica particles=3:1 to 7:1) and more preferably (average particle size of white pigment:average particle size of silica particles=3.5:1 to 6.5:1). The average particle size of the silica particles on the volume basis can be measured by a method which is the same as that of the average particle size of the white pigment on the volume basis.

Saccharide

The white ink according to the present application example can contain saccharides. The saccharides improves wattability of the white ink and has a function of improving an effect of suppressing the clogging of the ink jet recording head and a function of suppressing curing of the sediment.

Sugar may be formed of a monosaccharide and sugar of a disaccharide or more; only a monosaccharide; or sugar of a disaccharide or more. The type of saccharides can be appropriately selected in the range of acquired effects. That is, in a case where the effect of suppressing curing the sediment is intended to be focused, the sugar may be formed of only sugar having a disaccharide or more (not containing a monosaccharide). In addition, in a case where the sugar is formed of only by a disaccharide or more, the sugar may be formed of only sugar of a disaccharide and a trisaccharide or more.

The white ink according to the present application example may contain a monosaccharide and sugar of a disaccharide or more (an oligosaccharide (containing a trisaccharide and a tetrasaccharide) and a polysaccharide) as sugar. Examples of the monosaccharide and the sugar of a disaccharide or more include glucose, ribose, mannitol, mannose, fructose, ribose, xylose, arabinose, galactose, aldonic acid, glucitol, (sorbitol), maltose, sellobiose, lactose, sucrose, trehalose, and maltotriose. Here, the polysaccharide means sugar in a broad sense and can be used as a meaning of substances which are widely present in nature such as alginic acid, cyclodextrin, and cellulose. In addition, as a derivative of the sugar, reducing sugar of sugar [(for example, sugar alcohol is represented by (general formula $HOCH_2(CHOH)_nCH_2OH$ (here, n represents an integer of 2 to 5)], oxidized sugar (for example, aldonic acid, uronic acid, or the like), amino acid, or thio sugar can be exemplified. The type of sugar is not particularly limited, but a reducing sugar is particularly limited, and specific examples thereof include glucose and frucrose.

Further, in a case where a monosaccharide and sugar of a disaccharide or more are added, the content of the monosaccharide is preferably in the range of 5% by mass to 50% by mass and more preferably in the range of 20% by mass to 45% by mass based on the total sugar contained in the ink. In this manner, the sugar is acted as a moisturizing agent and clogging of the nozzle of the recording head can be prevented. Further, the sugar is adsorbed to particles of the white pigment so that aggregation of the particles is prevented and solidification on the bottom surface due to the sedimentation of a white color matter can be prevented. In addition, it is more preferable that the sugar contain a trisaccharide (a kind of the sugar of a disaccharide or more). In a case where a trisaccaride is contained, the content thereof, which is not particularly limited, is preferably in the range of 3% by mass to 90% by mass and more preferably in the range of 25% by mass to 85% by mass. In addition, in a case where a monosaccharide and sugar of a disaccharide or more are added to the ink, the monosaccharide and the sugar of a disaccharide or more may be separately added or mixed sugar containing both (for example, syrup) may be added.

Examples of commercially available products of the reducing sugar include "HS-500" (manufactured by Hayashibara Shoji, Ltd.), "HS-300" (manufactured by Hayashibara Shoji, Ltd.), "HS-60" (manufactured by Hayashibara Shoji, Ltd.), "HS-30" (manufactured by Hayashibara Shoji, Ltd.), and "HS-20" (manufactured by Hayashibara Shoji, Ltd.).

In a case of containing saccharides, the content thereof is preferably in the range of 2% by mass to 15% by mass and more preferably in the range of 5% by mass to 10% by mass based on the total mass of the white ink. When the content of the sugar is in the range, the drying property of an image to be recorded becomes excellent and curing of the sediment can be excellently suppressed.

Other Components

The white ink according to the present application example may contain an organic solvent, a surfactant, and water.

The white ink according to the present application example can be prepared similarly to the pigment ink in the related art using a known device in the related art such as a ball mill, a sand mill, an attritor, a basket mill, or a roll mill. At the time of preparation, it is preferable to remove coarse particles using a membrane filter or a mesh filter.

Third Application Example

According to the liquid ejection apparatus 1 of the above-described embodiment, since the sedimentation of the pigment component of the ink can be detected by distinguishing from other phenomena and the degree of the sedimentation can be detected, it is possible to perform the appropriate recovery process according to the degree of the sedimentation and to suppress unnecessary consumption of the ink due to the flushing process.

The white ink according to the present application example can suppress sedimentation due to aggregation of the pigment component and thus has excellent dispersion stability of the self-dispersion type pigment. Accordingly, since the number of execution of the flushing process can be suppressed by using the liquid ejection apparatus 1 according to the above-described embodiment and the white ink according to the present application example together, unnecessary consumption of the ink can be suppressed.

Hereinafter, the white ink according to the present application example will be described in detail.

The "dispersion stability" in the present specification means a property of forming a stable suspension by allowing solid particles to be dispersed in a liquid. The "ejection stability" means a property in which clogging is not generated and liquid droplets of the ink which is constantly stable are ejected from the nozzle.

An aqueous pigment ink for ink jet recording according to the present application example contains a self-dispersion type pigment, quaternary amino acid, and alkanediol. Further, the alkanediol contain at least 1,6-hexanediol and the quaternary amino acid is largely contained compared to 1,6-hexanediol. Hereinafter, an additive (component) which is contained in the pigment ink or can be contained therein will be described.

Self-dispersion Type Pigment

The aqueous pigment ink for ink jet recording according to the present application example contains the self-dispersion type pigment. The self-dispersion type pigment is a pigment reformed by bonding the surface thereof to a dispersibility imparting group (at least one of a hydrophilic functional group and salts thereof) as described above. By the surface reforming, the self-dispersion type pigment can be stably dispersed in the aqueous solvent without using a dispersant. Further, the pigment may be a white or metallic pigment such as ceramics, for example, titanium oxide or the like, resin fine particles, and a metal.

The self-dispersion type pigment can be produced by directly bonding a dispersibility imparting group to the surface of the pigment, or by indirectly bonding a dispersibility imparting group to the surface of the pigment through an alkyl group, an alkyl ether group, an aryl group, or the like. The self-dispersion type pigment processed from a pigment in this manner is dispersed or melted in an aqueous solution without a dispersant.

In addition, since the self-dispersion type pigment make the storage stability of the ink excellent and prevents clogging of the nozzle, the average particle size thereof is preferably in the range of 50 nm to 250 nm. Here, in the present specification, the average particle size is 50% average particle size (d50) in terms of sphere by a light dispersion method, and is a value obtained as follows.

Diffraction scattering light to be generated is measured by radiating light to particles in a dispersion medium using detectors arranged on the front, the side, and the backside of the dispersion medium. It is assumed that particles which have indeterminate form originally have a spherical shape, the total volume of a particle group converted to a sphere equivalent to the volume of the particles is set to 100%, a cumulative curve is acquired, and the point whose cumulative value becomes 50% is set as "50% average particle size (d50) in terms of sphere by a light dispersion method." As the measuring device of the diffraction scattering light, a laser diffraction scattering particle size distribution measuring machine LMS-2000e (trade name, manufactured by SEISHIN ENTERPRISE Co., Ltd.) can be exemplified.

As commercially available products of black self-dispersion type pigment in the self-dispersion type pigments, two different kinds of products are sold by Cabot corporation. CAB-O-JET200 (sulfonated carbon black) and CAB-O-JET300 (carboxyl carbon black) (hereinbefore, trade names manufactured by Cabot Corporation), and Bonjet Black CW-1 (trade name, manufactured by ORIENT CHEMICAL INDUSTRIES CO., LTD.) can be exemplified.

As the dispersibility imparting group to be bonded to the surface of the self-dispersion type pigment, which is not limited thereto, for example, a carboxyl group (—COOH), a ketone group (—CO), a hydroxyl group (—OH), a sulfonic acid group (—$SO_3H$), a phosphoric acid group (—$PO_3H_2$), a quaternary ammonium, and salts thereof can be exemplified. These dispersibility imparting groups become unstable by various substances (particularly, substances with high polarity) to be contained in the aqueous pigment ink for ink jet recording.

It is estimated that a capsule suppressing sedimentation in the vicinity of the self-dispersion type pigment is formed by allowing the quaternary amino acid and 1,6-hexanediol to be contained in the aqueous pigment ink for ink jet recording. Further, the self-dispersion type pigment according to the present application example can be referred to as so-called pseudo microcapsulated pigment because of the structure and the function thereof. In addition, "because of the structure" means that quaternary amino acid and 1,6-hexanediol forms a layer on the surface of the self-dispersion type pigment, and "because of the function" means that the self-dispersion type pigment with a layer formed on the surface thereof has excellent dispersion stability. However, the microcapsule means a microcapsule that forms a relatively rigid capsule such as a polymer, wax, or an inorganic material. The layer formation on the self-dispersion type pigment in the present application example contributes to improvement of the dispersibility by forming a capsule structure, but it is difficult to say that the capsule is not a rigid capsule but a microcapsulated pigment because the capsule is formed of a non-polymer. Accordingly, the layer formation on the self-dispersion type pigment in the present application example has properties intermediate between a dispersant and a microcapsule, and this can be said as a pseudo microcapsulated self-dispersion type pigment.

When the self-dispersion type pigment in the present application example is pseudo microcapsulated, even when the pigment is contained in the ink with high density compared to a microcapsulated pigment in the related art, the ink with low viscosity and excellent ejection stability can be obtained.

In addition, since the self-dispersion type pigment has excellent dispersion stability and sedimentation due to the aggregation of the pigment can be suppressed, effects of excellent storage stability of the ink are exerted. Further, an aqueous pigment ink for ink jet recording containing the pseudo microcapsulated pigment has excellent dispersion stability of the pigment and an excellent coloring property on a recording material.

The self-dispersion type pigment may be used alone or in combination of two or more kinds thereof. In addition, the content of the self-dispersion type pigment is preferably in the range of 2% by mass to 15% by mass and more preferably in the range of 5% by mass to 12% by mass based on the total mass (100% by mass) of the aqueous pigment ink for ink jet recording. When the content thereof is more than or equal to 2% by mass, the print density becomes sufficient and the coloring property is excellent. Further, the content thereof is less than or equal to 15% by mass, clogging does not occur in the nozzle and the ejection stability becomes excellent.

Quaternary Amino Acid

The aqueous pigment ink for ink jet recording according to the application example contains quaternary amino acids. The quaternary amino acid means an amino acid containing a quaternary ammonium ion having four substituted or unsubstituted alkyl groups as an amino group.

The quaternary amino acid has functions of a pH adjustment function, a moisturizing function, and a function as a curl inhibitor of a recorded medium which are functions of an amino acid in common. In addition, the quaternary amino acid has excellent chemical stability compared to a tertiary amino acid, a secondary amino acid, and a primary amino acid, and is suitable for the storage stability of the ink for a long period of time. By allowing trimethylglycine to be contained in 1,6-hexanediol described below and the aqueous pigment ink for ink jet recording as a quaternary amino acid, the self-dispersion type pigment is coated with a thick layer and has excellent dispersion stability. As commercially available products of the quaternary amino acid, Amino coat (registered trademark, trimethylglycine, trade name manufactured by Asahi Kasei Chemicals Corporation) is exemplified preferably. The quaternary amino acid may be used along or in combination of two or more kinds thereof.

In the present application example, the quaternary amino acid is largely contained compared to 1,6-hexanediol described below. In this case, it is estimated that sufficient pseudo microcapsule is formed in the vicinity of the self-dispersion type pigment and the dispersion stability of the self-dispersion type pigment becomes excellent because sedimentation due to aggregation of the pigment can be actually suppressed (because a centrifugal sedimentation rate described below can be lowered).

The content of the quaternary amino acid is preferably in the range of 1% by mass to 30% by mass and more preferably in the range of 4% by mass to 20% by mass based on the total mass (100% by mass) of the aqueous pigment ink for ink jet recording. When the content is in the range, a layer is formed by cooperation of the quaternary amino acid and 1,6-hexanediol with respect to the self-dispersion pigment and the dispersion stability of the self-dispersion type pigment becomes excellent.

Alkanediol

The aqueous pigment ink for ink jet recording of the present application example contains alkanediol and the alkanediol at least contains 1,6-hexanediol.

1,6-Hexanediol

The aqueous pigment ink for ink jet recording contains 1,6-hexanediol. The ink containing 1,6-hexanediol is dried faster with respect to plain paper and a color image having a high image quality with less bleeding can be formed. Further, as described above, when the quaternary amino acid and 1,6-hexanediol having a predetermined quantitative relationship cooperates with respect to the self-dispersion type pigment, as a result, dispersion stability of the self-dispersion type pigment becomes excellent. The alkanediol is preferably formed of 1,6-hexanediol. In this case, as described above, the cooperation of the quaternary amino acid and 1,6-hexanediol can be further strengthened.

In the present application example, 1,6-hexanediol is contained in the aqueous pigment ink for ink jet recording in a smaller amount than the quaternary amino acid. Here, the reason of the significance of crystalline 1,6-hexanediol and ionic quaternary amino acid and the quantitative relationship between those influencing on the dispersion stability of the self-dispersion type pigment can be described as follows.

Since the quaternary amino acid has a carboxyl group and an amino group as a hydrophobic group and two kinds of hydrophilic groups, the quaternary amino acid tends to be adhered to the surface of the self-dispersion type pigment. When the quaternary amino acid is adhered to the surface of the self-dispersion type pigment, the carboxyl group and the amino group improve a ζ (zeta) potential of the self-dispersion type pigment and a charge repulsion force is improved, and accordingly the dispersion of the self-dispersion type pigment is stabilized.

Further, 1,6-hexanediol is a crystalline substance, but is easily melted in water. However, 1,6-hexanediol employs a layer mode in the vicinity of the hydrophobic group in the quaternary amino acid (for example, a methyl group in the trimethylglycine).

As a result, when the quaternary amino acid and 1,6-hexanediol in a smaller amount than that of the quaternary amino acid are present in the ink, the self-dispersion type pigment has the same function as that of the microcapsulated pigment are present together in the ink, and the self-dispersion type pigment has a function which is the same as that of the microcapsulated pigment, and therefore sedimentation due to aggregation of the pigment can be suppressed and the dispersion stability of the self-dispersion pigment becomes excellent.

On the other hand, it is preferable that 1,6-hexanediol be contained larger than the total amount of alkanediol in the aqueous pigment ink for ink jet recording. In the case, while 1,6-hexanediol is adhered to the self-dispersion pigment, inhibition by other kinds of alkanediols is suppressed. It is estimated that 1,6-hexanediol and alkanediol other than 1,6-hexanediol have a competitive (antagonistic) relationship in the adhesion to the self-dispersion type pigment. Accordingly, 1,6-hexanediol in alkanediols can be preferentially adhered to the self-dispersion type pigment by 1,6-hexanediol being largely contained compared to the total amount of alkanediol other than 1,6-hexanediol, and, as a result, the layer formation by the cooperation of the quaternary amino acid and 1,6-hexanediol can be stabilized.

When the quaternary amino acid and 1,6-hexanediol in an amount smaller than the quaternary amino acid are present together in the ink and a condition in which adhesion of 1,6-hexanediol to the pigment is not inhibited is satisfied, sedimentation due to aggregation of the pigment can be further suppressed and the dispersion stability of the self-dispersion type pigment becomes excellent.

Further, the content of 1,6-hexanediol is preferably in the range of 1% by mass to 15% by mass and more preferably in the range of 3% by mass to 12% by mass based on the total mass (100% by mass) of the aqueous pigment ink for ink jet recording. When the content is in the range, the quaternary amino acid and 1,6-hexanediol form a layer by cooperating with respect to the self-dispersion type pigment and the dispersion stability of the self-dispersion type pigment becomes excellent.

Alkanediol Other than 1,6-Hexanediol

The aqueous pigment ink for ink jet recording according to the present application example may contain alkanediol other than 1,6-hexanediol as long as alkanediol is contained in an amount smaller than 1,6-hexanediol as described above. In addition, 10% by mass of alkanediol other than 1,6-hexanediol can be contained based on the total mass (100% by mass) of the aqueous pigment ink for ink jet recording.

Surfactant

The aqueous pigment ink for ink jet recording according to the present application example may contain a surfactant. As the surfactant, a nonionic surfactant is preferable and an acetylene glycol-based surfactant is more preferable. By the acetylene glycol-based surfactant being contained in the aqueous pigment ink for ink jet recording, inhibition of adsorption of the quaternary amino acid to the self-dispersion type pigment can be suppressed and the aqueous pigment ink for ink jet recording with excellent dispersion stability of the self-dispersion type pigment can be obtained.

The reason for the above, when a three-dimensional structure is included besides a linear structure in the nonionic surfactant, it is estimated that adhesion to the self-dispersion type pigment becomes difficult compared to the quaternary amino acid. In the nonionic surfactant having a three-dimensional structure, an acetylene glycol-based surfactant is preferable as described above.

The acetylene glycol-based surfactant is a nonionic-based surfactant which includes an acetylene group in the center and has a symmetrical structure and is applied to aqueous materials in various field as a wetting agent that is hardly foaming. In addition, the acetylene glycol-based surfactant has excellent functions of wetting, defoaming, and dispersing. Further, since the acetylene glycol-based surfactant is glycol which is exceedingly stabilized as a molecular structure, has a small molecular amount, and has an effect of decreasing the surface tension of water, permeability or bleeding to the recorded medium of the ink can be appropriately controlled.

When the quaternary amino acid and 1,6-hexanediol in an amount smaller than the quaternary amino acid are present together in the ink and a condition in which adhesion of the quaternary amino acid to the pigment is not inhibited is satisfied, sedimentation due to aggregation of the pigment can be further suppressed and the dispersion stability of the self-dispersion type pigment becomes excellent. Examples of commercially available products of the acetylene glycol-based surfactant include Surfinols 104 (series), 420, 440, 465, 485, 104, and STG (hereinbefore, all trade names, manufactured by Air Products and Chemicals. Inc.), Olfins STG, PD-001, SPC, E1004, and E1010 (hereinbefore, all trade names, manufactured by Nissan Chemical Industry Co., Ltd.), Acetylenol E00, E40, E100, and LH (hereinbefore, all trade names, manufactured by Kawaken Fine Chemicals Co., Ltd.). The acetylene glycol surfactant may be used alone or in combination of two or more kind thereof.

The content of the acetylene glycol-based surfactant is preferably in the range of 0.1% by mass to 3.0% by mass and more preferably in the range of 0.3% by mass to 2.0% by mass based on the total mass (100% by mass) of the pigment ink for ink jet recording. When the content thereof is in the range, the glossiness and permeability become excellent.

Water

Water included in the aqueous pigment ink for ink jet recording according to the present application example is a main solvent. Examples of the water include pure water such as ion exchange water, ultrafiltered water, reverse osmosis water, or distilled water and ultrapure water. Among these, since generation of molds and bacteria is prevented and an ink composition can be stored for a long period of time, water sterilized by ultraviolet radiation or addition of hydrogen peroxide is preferable.

Other Additives

The aqueous pigment ink of ink jet recording according to the present application example may contain other than additives (components).

According to the present application example, it is possible to provide an aqueous pigment ink for ink jet recording in which sedimentation due to aggregation of the pigment can be suppressed and the dispersion stability of the self-dispersion type pigment is excellent. In addition, when the quaternary amino acid and 1,6-hexanediol in an amount smaller than the quaternary amino acid are present together in the ink and a condition in which adhesion of the quaternary amino acid and 1,6-hexanediol to the pigment is not inhibited is satisfied, sedimentation due to aggregation of the pigment can be further suppressed and the dispersion stability of the self-dispersion type pigment becomes highly excellent.

The entire disclosure of Japanese Patent Application No. 2013-253224, filed Dec. 6, 2013 is expressly incorporated by reference herein.

What is claimed is:

1. A liquid ejection apparatus, comprising:

an ejection unit that includes a nozzle ejecting a liquid that contains a pigment, a pressure chamber communicating with the nozzle, and a piezoelectric element provided in the pressure chamber;

a driving signal generation unit that generates a driving signal that allows the piezoelectric element to be displaced such that the pressure chamber expands or is contracted;

a residual vibration detection unit that detects a cycle of a residual vibration waveform of the piezoelectric element that is generated by the driving signal being applied to the piezoelectric element and indicating a value according to change of pressure in the pressure chamber; and a determination unit that determines the pigment of the liquid is settled based on the cycle of the residual vibration waveform detected by the residual vibration detection unit, wherein:

the liquid containing the pigment is a white ink jet ink for textile printing that contains a white pigment and a urethane resin, and an average particle size of the white pigment is greater than or equal to 2 and the average particle size of the urethane resin is smaller than or equal to 12.

2. The liquid ejection apparatus according to claim 1, wherein the determination unit determines that the state of the liquid is normal in a case where the cycle of the residual vibration waveform is in a predetermined range, the liquid is thickened in a case where the cycle of the residual vibration waveform is longer than the predetermined range, and the pigment is settled in a case where the cycle of the residual vibration waveform is shorter than the predetermined range.

3. The liquid ejection apparatus according to claim 2, wherein the residual vibration detection unit detects the cycle and amplitude of the residual vibration waveform, and the determination unit determines that a degree of sedimentation of the pigment is in a first sedimentation state in a case where the cycle of the residual vibration waveform is shorter than the predetermined cycle and the amplitude of the residual vibration waveform is greater than the predetermined value, and the degree of sedimentation of the pigment is in a second sedimentation state whose degree of sedimentation progresses further than that of the first sedimentation state in a case where the cycle of the residual vibration waveform is shorter than the predetermined cycle and the amplitude of the residual vibration waveform is smaller than or equal to the predetermined value.

4. The liquid ejection apparatus according to claim 3, further comprising a control unit that controls the driving signal generation unit based on a determination result of the determination unit, wherein the control unit controls the driving signal generation unit so as to generate a stirring driving signal which allows the pressure chamber to expand or be contracted such that the liquid of the pressure chamber is stirred without allowing the liquid to be ejected from the nozzle in a case where the determination unit determines that the degree of sedimentation of the pigment is in the first sedimentation state, and controls the driving signal generation unit so as to generate a flushing driving signal which allows the whole liquid filled in the pressure chamber to be ejected from the nozzle in a case where the determination unit determines that the degree of sedimentation of the pigment is in the second sedimentation state.

5. A liquid ejection apparatus comprising:

an ejection unit that includes a nozzle ejecting a liquid that contains a pigment, a pressure chamber communicating with nozzle, and a piezoelectric element provided in the pressure chamber;

a driving signal generation unit that generates a driving signal that allows the piezoelectric element to be displaced such that the pressure chamber expands or is contracted;

a residual vibration detection unit that detects a cycle of a residual vibration waveform of the piezoelectric element that is generated by the driving signal being applied to the piezoelectric element and indicating a value according to change of pressure in the pressure chamber; and a determination unit that determines the pigment of the liquid is settled based on the cycle of the residual vibration waveform detected by the residual vibration detection unit, wherein:

the liquid containing the pigment is a white ink for ink jet recording, has an average particle size of 200 nm to 400 nm, contains a white pigment made of a metal oxide, and satisfies a relationship of $0.5\times A \leq V \leq 1.3\times A$, and A represents a content (% by mass) of the white pigment contained in the white ink for ink jet printing and V represents a volume ratio (%) of the white pigment based on the total volume of the white ink for ink jet recording when the white pigment is completely settled in the white ink for ink jet recording.

6. A liquid ejection apparatus comprising:

an ejection unit that includes a nozzle ejecting a liquid that contains a pigment, a pressure chamber communicating with the nozzle, and a piezoelectric element provided in the pressure chamber;

a driving signal generation unit that generates a driving signal that allows the piezoelectric element to be displaced such that the pressure chamber expands or is contracted;

a residual vibration detection unit that detects a cycle of a residual vibration waveform of the piezoelectric element that is generated by the driving signal being applied to the piezoelectric element and indicating a value according to change of pressure in the pressure chamber; and a determination unit that determines the pigment of the liquid is settled based on the cycle of the residual vibration waveform detected by the residual vibration detection unit; wherein the liquid containing the pigment is an ink which includes a self-dispersion type pigment, a quaternary amino acid, and alkanediol, in which the alkanediol contains at least 1,6-hexanediol, and the quaternary amino acid is contained in an amount larger than that of the 1,6-hexanediol.

* * * * *